US010859932B2

(12) United States Patent
Sugimoto et al.

(10) Patent No.: US 10,859,932 B2
(45) Date of Patent: Dec. 8, 2020

(54) TONER, TONER ACCOMMODATING UNIT, AND IMAGE FORMING APPARATUS

(71) Applicants: Tsuyoshi Sugimoto, Shizuoka (JP); Shinya Nakayama, Shizuoka (JP); Hiroshi Yamada, Shizuoka (JP); Hideyuki Santo, Kanagawa (JP); Ryuta Chiba, Kanagawa (JP); Suzuka Amemori, Shizuoka (JP); Kohsuke Nagata, Shizuoka (JP)

(72) Inventors: Tsuyoshi Sugimoto, Shizuoka (JP); Shinya Nakayama, Shizuoka (JP); Hiroshi Yamada, Shizuoka (JP); Hideyuki Santo, Kanagawa (JP); Ryuta Chiba, Kanagawa (JP); Suzuka Amemori, Shizuoka (JP); Kohsuke Nagata, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/522,567

(22) PCT Filed: Oct. 8, 2015

(86) PCT No.: PCT/JP2015/005125
§ 371 (c)(1),
(2) Date: Apr. 27, 2017

(87) PCT Pub. No.: WO2016/067531
PCT Pub. Date: May 6, 2016

(65) Prior Publication Data

US 2018/0024452 A1 Jan. 25, 2018

(30) Foreign Application Priority Data

Oct. 30, 2014 (JP) ..... 2014-221459
Sep. 18, 2015 (JP) ..... 2015-185840

(51) Int. Cl.
*G03G 9/087* (2006.01)

(52) U.S. Cl.
CPC ..... *G03G 9/08755* (2013.01); *G03G 9/08764* (2013.01); *G03G 9/08793* (2013.01); *G03G 9/08795* (2013.01); *G03G 9/08797* (2013.01)

(58) Field of Classification Search
CPC ..... G03G 9/08755; G03G 9/08793; G03G 9/08795; G03G 9/08797; G03G 9/08764
See application file for complete search history.

(56) References Cited

U.S. PATENT DOCUMENTS 4,833,057 A * 5/1989 Misawa ..... G03G 9/08755 430/109.4
5,296,546 A * 3/1994 Kishida ..... C08F 285/00 525/281

(Continued)

FOREIGN PATENT DOCUMENTS

CN 102981381 A 3/2013
EP 0 256 136 A1 2/1988

(Continued)

OTHER PUBLICATIONS

International Search Report dated Dec. 28, 2015 for counterpart International Patent Application No. PCT/JP2015/005125 filed Oct. 8, 2015.

(Continued)

*Primary Examiner* — Peter L Vajda
(74) *Attorney, Agent, or Firm* — Oblon, McClelland, Maier & Neustadt, L.L.P.

(57) ABSTRACT

A toner, including: a polyester resin, wherein the polyester resin has a structure represented by any one of formulas 1) to 3) below: 1) R1-(NHCONH-R2)n-, 2) R1-(NHCOO-R2)n-, and 3) R1-(OCONH-R2)n-, where n is 3 or more, R1 represents an aromatic organic group or an aliphatic organic group, and R2 represents a group derived from a resin that is polyester formed of polycarboxylic acid, polyol, or both thereof; or that is a modified polyester obtained by modifying polyester with isocyanate.

(Continued)

-continued

11 Claims, 3 Drawing Sheets

(56) References Cited

U.S. PATENT DOCUMENTS

| | | | | |
|---|---|---|---|---|
| 5,441,840 | A | 8/1995 | Imai et al. | |
| 9,354,533 | B2 * | 5/2016 | Takahashi | G03G 9/0804 |
| 2010/0160548 | A1 | 6/2010 | Noordover et al. | |
| 2013/0059247 | A1 | 3/2013 | Sugimoto et al. | |
| 2013/0157193 | A1 * | 6/2013 | Moritani | G03G 9/08728 430/109.4 |
| 2014/0080046 | A1 | 3/2014 | Asahina et al. | |
| 2015/0024312 | A1 | 1/2015 | Shiba et al. | |
| 2016/0209766 | A1 | 7/2016 | Chiba et al. | |

FOREIGN PATENT DOCUMENTS

| | | |
|---|---|---|
| JP | 06-175388 | 6/1994 |
| JP | 2579150 | 11/1996 |
| JP | 09-281746 | 10/1997 |
| JP | 11-133665 | 5/1999 |
| JP | 2001-158819 | 6/2001 |
| JP | 2002-287400 | 10/2002 |
| JP | 2002-351143 | 12/2002 |
| JP | 2004-046095 | 2/2004 |
| JP | 2007-271789 | 10/2007 |
| JP | 2010-503736 | 2/2010 |
| JP | 2011-070128 | 4/2011 |
| JP | 2013-054178 | 3/2013 |
| JP | 2015-052698 | 3/2015 |
| WO | WO87/004811 | 8/1987 |
| WO | WO 2013/141029 A1 | 9/2013 |

OTHER PUBLICATIONS

Extended European Search Report dated Aug. 31, 2017 in Patent Application No. 15854366.0.

Combined Chinese Office Action and Search Report dated Jan. 20, 2020 in corresponding Chinese Patent Application No. 201580070014.3 (with English Translation), 21 pages.

* cited by examiner

[Fig. 1]
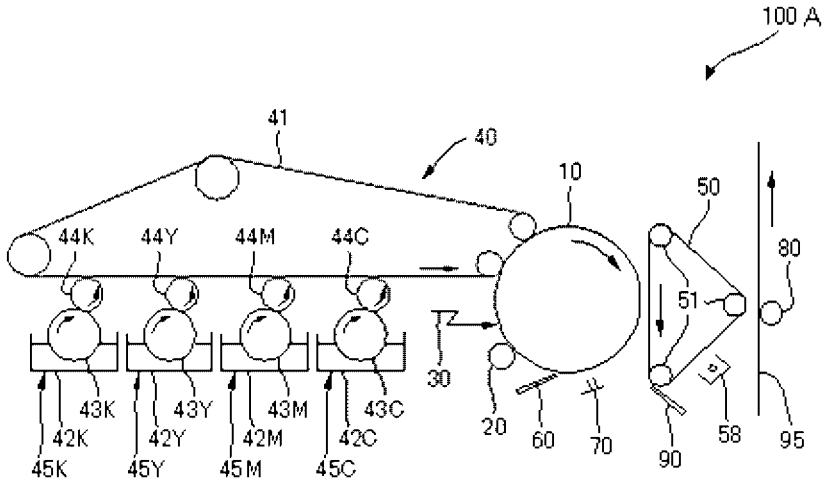
[Fig. 2]
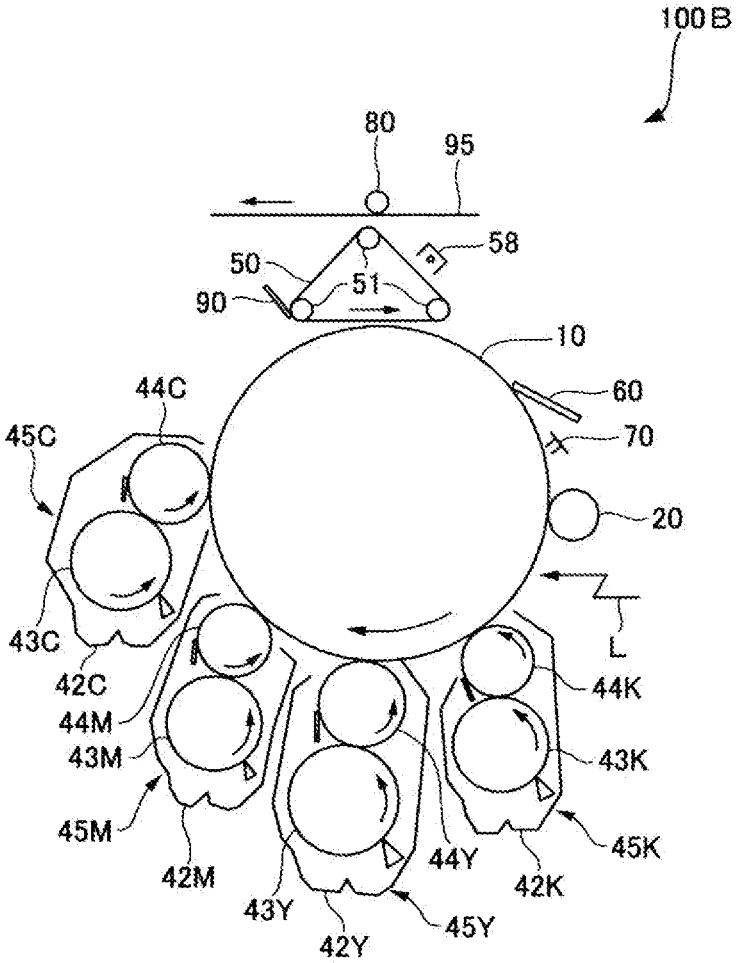

[Fig. 3]
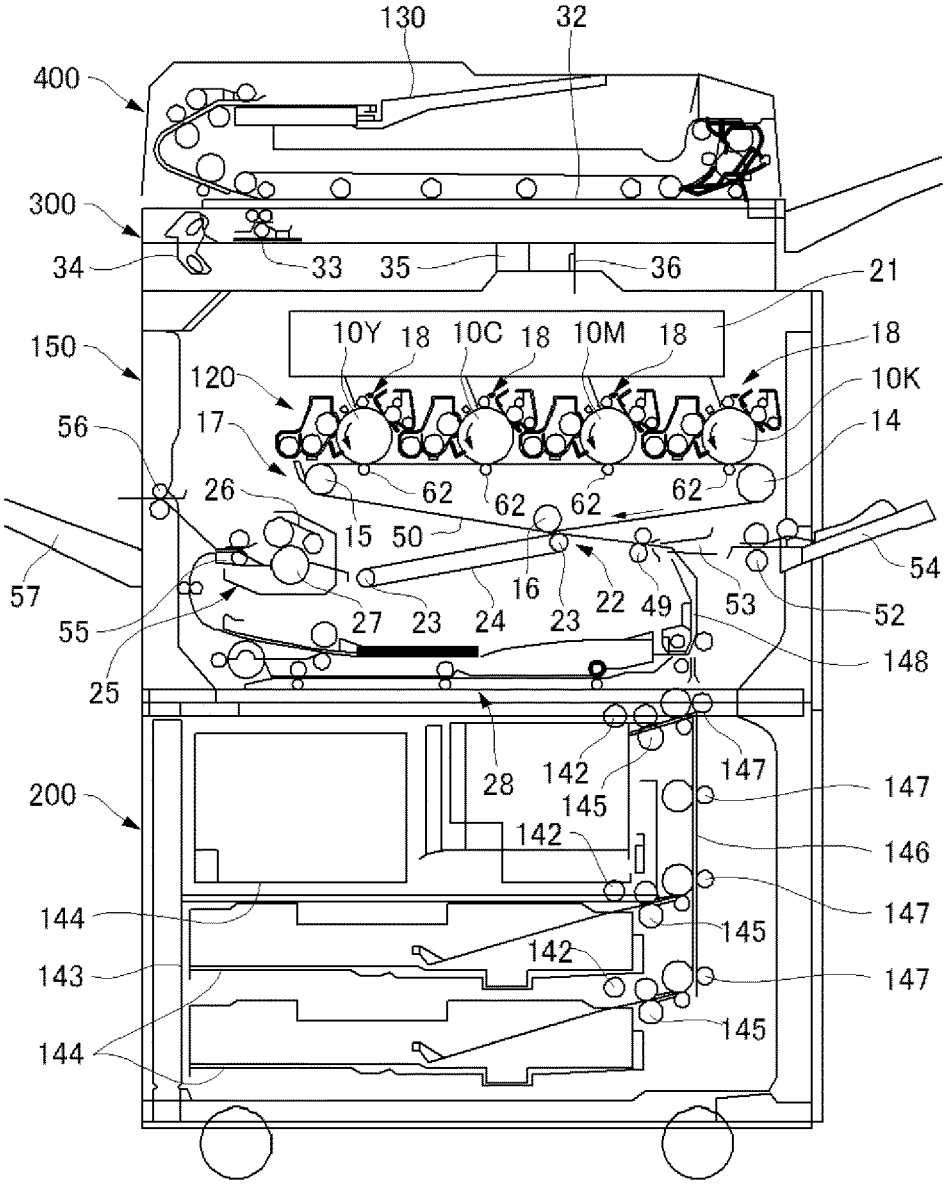
[Fig. 4]
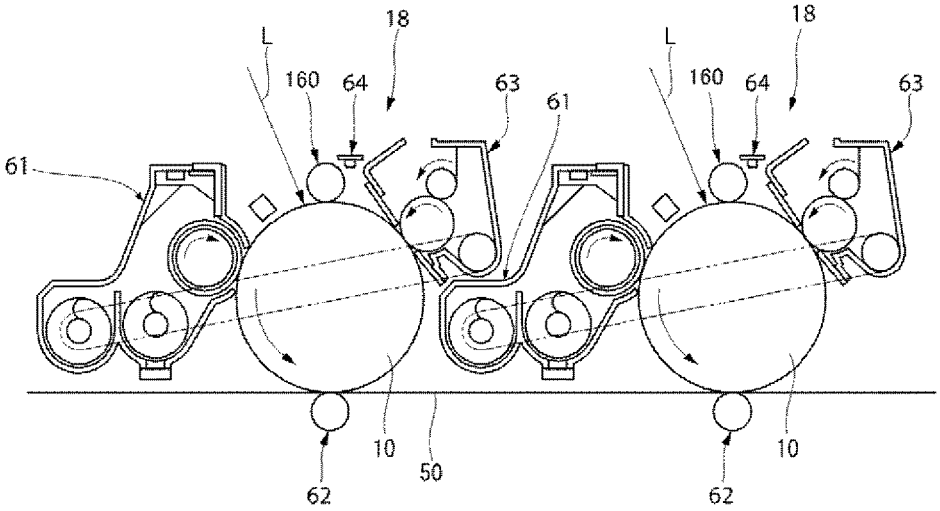

[Fig. 5]
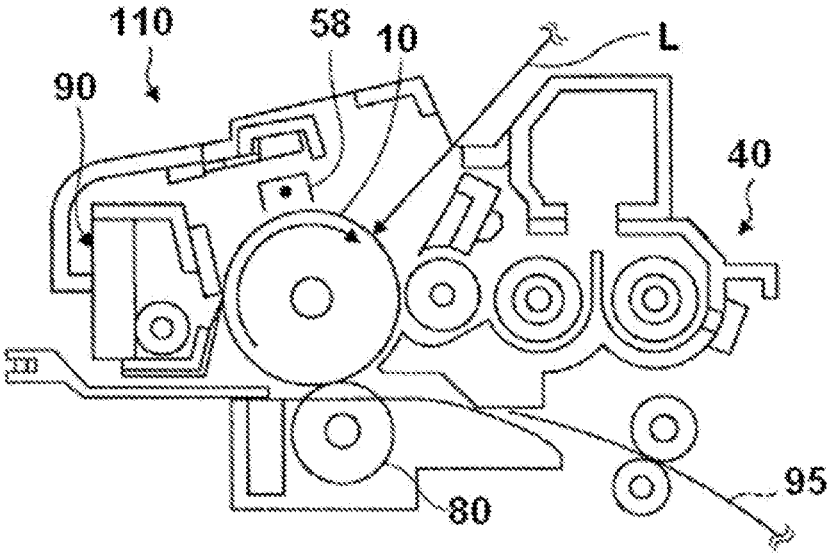
[Fig. 6]
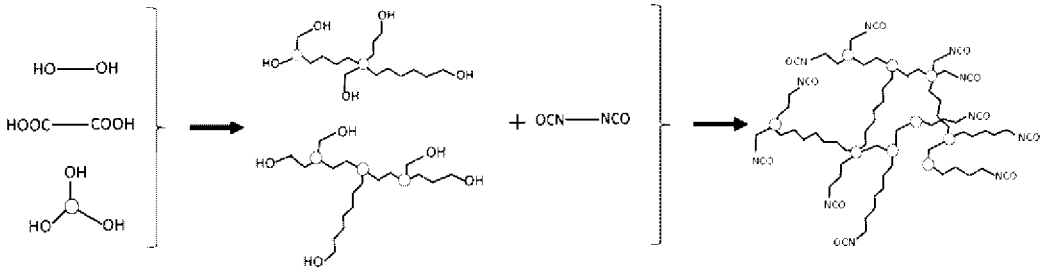
[Fig. 7]
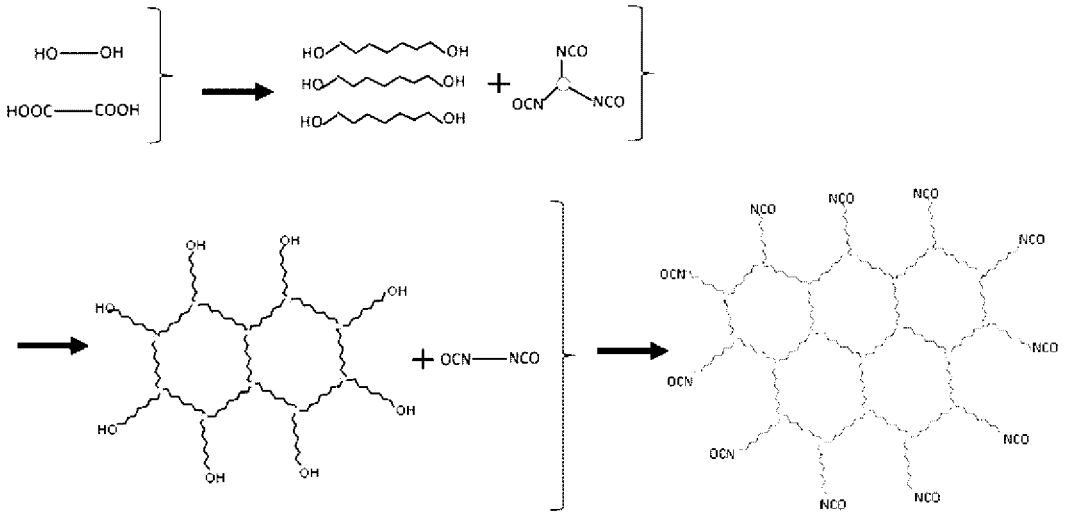

TONER, TONER ACCOMMODATING UNIT, AND IMAGE FORMING APPARATUS

TECHNICAL FIELD

The present invention relates to a toner, a toner accommodating unit, and an image forming apparatus.

BACKGROUND ART

In recent years, toners have been required to have smaller particle diameters and hot offset resistance for increasing quality of output images, to have low temperature fixing ability for energy saving, and to have heat resistant storage stability for the toners to be resistant to high-temperature, high-humidity conditions during storage and transportation after production. In particular, improvement in low temperature fixing ability is very important because power consumption in fixing occupies much of power consumption in an image forming step.

Conventionally, toners produced by the kneading pulverizing method have been used. In the toners produced by the kneading pulverizing method, is difficulty encountered in making them have smaller particle diameters, and their shapes are indefinite and their particle size distribution is broad, for which these toners have the following problems, for example: the quality of output images is not sufficient; and the fixing energy required is high. Also, when wax (release agent) has been added for improving fixing ability, the toners produced by the kneading pulverizing method are cracked at the interfaces with the wax upon pulverization, so that much of the wax is disadvantageously present on the toner surface. As a result, although releasing effects can be obtained, deposition (filming) of the toners on carriers, photoconductors, and blades will easily occur. Thus, their entire performances have not been satisfactory, which is problematic.

Then, in order to overcome the above problems accompanied by the kneading pulverizing method, toner production methods based on the polymerization method have been proposed. Toners produced by the polymerization method are easily allowed to have smaller particle diameters, and their particle size distribution is sharper than that of the toners produced by the pulverization method and moreover it is possible to enclose a release agent. In one disclosed method for producing the toner based on the polymerization method, toners are produced from elongated reaction products of urethane-modified polyesters serving as a toner binder for the purpose of improving the low temperature fixing ability and hot offset resistance (see, for example, PTL 1).

In addition, there are disclosed methods for producing toners excellent in powder flowability and transferability when they are formed to have smaller particle diameters, as well as in all of heat resistant storage stability, low temperature fixing ability, and hot offset resistance (see, for example, PTLs 2 and 3).

Further, there are disclosed methods for producing toners including an aging step for producing a toner binder having a stable molecular weight distribution to achieve both of low temperature fixing ability and hot offset resistance (see, for example, PTLs 4 and 5).

These proposed techniques, however, do not attain high-level low temperature fixing ability that has been demanded recently.

Then, in order to attain high-level low temperature fixing ability, there is a proposed toner containing a resin including a crystalline polyester resin, and a release agent, where the resin and a wax are incompatible to each other, to form a phase separation structure having a sea-island form (see, for example, PTL 6).

Also, there is a proposed toner containing a crystalline polyester resin, a release agent, and a graft polymer (see, for example, PTL 7).

According to these proposed techniques, a crystalline polyester resin more rapidly melts than a non-crystalline polyester resin does, which makes it possible to allow the resultant toner to have a lowered fixing temperature. However, even if a crystalline polyester resin that corresponds to the island in the sea-island phase separation structure melts, a non-crystalline polyester resin that corresponds to most of the sea in the sea-island phase separation structure does not melt. As a result, when both the crystalline polyester resin and the non-crystalline polyester resin melt to some extent, the resultant toner is not fixed. Therefore, these proposed techniques do not satisfy high-level low temperature fixing ability, which has been highly demanded recently.

In order to obtain higher-level low temperature fixing ability, there has been proposed a toner containing non-crystalline polyester obtained by reacting a curing agent with a reactive precursor that has a branched structure and that has significantly low glass transition temperature (see, for example, PTL 8).

This proposed technique utilizes the following properties of a polyester resin having significantly low glass transition temperature: being deformed at low temperature; and being deformed with heat during fixing and pressurization, and is easily adhered to a recording medium such as paper at lower temperature. Moreover, the reactive precursor is non-linear, and thus a network structure is formed, where the network structure contains branched structures in the molecular skeleton, and contains three-dimensional molecular chains. Therefore, the polyester resin is deformed at low temperature, and exhibits rubber-like properties that it does not flow. As a result, heat resistant storage stability and hot offset resistance of the toner can be retained.

According to this technique, however, the three-dimensional network structure is obtained through an ester reaction of diol, dicarboxylic acid, a polyhydric alcohol, or an acid, and the polyhydric alcohol or the acid to be a branched structure ununiformly exists. Therefore, there may exist both portions where the network structure is loose and portions where the network structure is tight.

The loose portion may lead to deterioration in heat resistant storage stability, and the tight portion may lead to deterioration in low temperature fixing ability, image glossiness, image density, and color reproducibility.

Moreover, the portions forming the branch are ester structures, and have weak aggregation force as crosslinking points of the resin. Therefore, without the network structure densely formed, heat resistant storage stability may be difficult to retain, and sufficient low temperature fixing ability and image glossiness cannot be obtained. Accordingly, the resultant toner does not satisfy high-level low temperature fixing ability or image quality, although these have been recently demanded.

Accordingly, demand has arisen for a toner that does not cause filming, and that is excellent in low temperature fixing ability, hot offset resistance, high glossiness, high color reproducibility, and heat resistant storage stability.

CITATION LIST

Patent Literature

PTL 1: Japanese Patent Application Laid-Open (JP-A) No. 11-133665
PTL 2: JP-A No. 2002-287400
PTL 3: JP-A No. 2002-351143
PTL 4: Japanese Patent (JP-B) No. 2579150
PTL 5: JP-A No. 2001-158819
PTL 6: JP-A No. 2004-46095
PTL 7: JP-A No. 2007-271789
PTL 8: JP-B No. 5408210

SUMMARY OF INVENTION

Technical Problem

The present invention aims to solve the above problems pertinent in the art, and to achieve the following object. That is, an object of the present invention is to provide a toner that does not cause filming, and that is excellent in low temperature fixing ability, hot offset resistance, high glossiness, high color reproducibility, and heat resistant storage stability.

Solution to Problem

Means for solving the above problems are as follows. That is, a toner of the present invention is a toner containing a polyester resin, where the polyester resin has a structure represented by any one of formulas 1) to 3) below:

1) R1-(NHCONH-R2)n-,
2) R1-(NHCOO-R2)n-, and
3) R1-(OCONH-R2)n-, (where, n is 3 or more, R1 represents an aromatic organic group or an aliphatic organic group, and R2 represents a group derived from a resin that is polyester formed of polycarboxylic acid, polyol, or both thereof; or that is a modified polyester obtained by modifying polyester with isocyanate).

Advantageous Effects of Invention

According to the present invention, it is possible to solve the above problems pertinent in the art, and to provide a toner that does not cause filming, and that is excellent in low temperature fixing ability, hot offset resistance, high glossiness, high color reproducibility, and heat resistant storage stability.

BRIEF DESCRIPTION OF DRAWINGS

FIG. 1 is a schematic structural view of one example of an image forming apparatus of the present invention.

FIG. 2 is a schematic structural view of another example of an image forming apparatus of the present invention.

FIG. 3 is a schematic structural view of another example of an image forming apparatus of the present invention.

FIG. 4 is a partially enlarged view of FIG. 3.

FIG. 5 is a schematic structural view of one example of a process cartridge.

FIG. 6 is an image view illustrating a branched structure of the conventional polyester resins.

FIG. 7 is an image view illustrating a branched structure of a polyester resin defined in the present invention.

DESCRIPTION OF EMBODIMENTS (Toner)

A toner of the present invention contains a polyester resin, preferably contains a crystalline polyester resin, and further contains other components such as a colorant, if necessary.

The polyester resin has a structure represented by any one of formulas 1) to 3) below:

1) R1-(NHCONH-R2)n-,
2) R1-(NHCOO-R2)n-, and
3) R1-(OCONH-R2)n-, (where, n is 3 or more, R1 represents an aromatic organic group or an aliphatic organic group, and R2 represents a group derived from a resin that is polyester formed of polycarboxylic acid, polyol, or both thereof; or that is a modified polyester obtained by modifying polyester with isocyanate).

That is, the polyester resin has a structure obtained by binding R2 that is a polyester part or a modified polyester part with R1 corresponding to a branched structure via a urethane group or a urea group.

In order to improve low temperature fixing ability, it is believed that a method for lowering a molecular weight or a method for lowering a glass transition temperature is used so that a polyester resin (e.g., a non-crystalline polyester resin) and a crystalline polyester resin melt together. However, when melt viscosity has been lowered by simply lowering a glass transition temperature of the polyester resin, or lowering a molecular weight of the polyester resin, it is easily conceived that the resultant toner may be deteriorated in heat resistant storage stability and high temperature offset property during fixing.

Meanwhile, in the toner of the present invention, the polyester resin has a branched structure via a urethane bond or a urea bond, and molecular chains become a three-dimensional network structure. Thus, the polyester resin is deformed at low temperature, but exhibits rubber-like properties that it does not flow. Therefore, when even a glass transition temperature of the polyester resin is significantly lowered, heat resistant storage stability and hot offset resistance of the toner can be retained.

Moreover, when the network structure is ununiformly formed, a rough portion of the network is insufficient in flow suppression of the resin, and thus the toner is deteriorated in heat resistant storage stability. In addition, a dense portion of the network is insufficient in deforming property of the resin, and thus the resultant toner may be deteriorated in low temperature fixing ability and image glossiness.

For example, in the polyester resin described in JP-B No. 5408210 (corresponding to PTL 8) in the Background Art, when a portion forming a branch is an ester structure (i.e., when a portion of R2 has a branched structure in any one of the formulas 1) to 3), defined in the present application), as illustrated in an image view of FIG. 6, branched structures ununiformly exist, and thus the resultant toner is not sufficient in low temperature fixing ability and image glossiness. FIG. 6 is a schematic view illustrating a branched structure of conventional polyester resins obtained by the conventional methods. In FIG. 6, a step indicated by the left-hand arrow is "synthesis of a base polyester", and a step indicated by the right-hand arrow is "formation into prepolymer".

Therefore, in the conventional polyester resins, it is not easy to obtain well-balanced results satisfying all of the following items: being excellent in low temperature fixing ability and image glossiness, and being excellent in heat resistant storage stability and hot offset resistance.

However, the polyester resin of the present invention can form a network structure obtained by combining R1 and R2 via a urethane group or a urea group after synthesizing R2 that is a portion of polyester or a portion of modified polyester. Thus, the network structure can be made uniformly by narrowing a molecular weight distribution of R2.

A state of the polyester resin including the structure represented by any one of the formulas 1) to 3), defined in the present application, is given as an image view of FIG. 7. In FIG. 7, a step indicated by the upper arrow is "synthesis of a base polyester", a step indicated by the left-hand arrow is "formation of a branched structure", and a step indicated by the right-hand arrow is "formation into prepolymer". FIG. 7 is a schematic view illustrating a branched structure of a polyester resin obtained by the synthesis method of the present invention, which will be described hereinafter. The length of a portion of a straight-chain polyester resin is uniform, and thus a branched structure of the polyester resin is made uniformly as illustrated in FIG. 7.

Accordingly, the network structure of the polyester resin is made uniformly, and thus all of heat resistant storage stability, low temperature fixing ability, image glossiness, and hot offset resistance of the toner can be achieved.

Moreover, since the polyester resin includes in the portion of the branched structure, a urethane bond or a urea bond that exhibits high aggregation force and thus exhibits behaviors like strong crosslinking point. Therefore, even if the network structure has a rougher network structure, an effect of inhibiting flow of the resin is strongly exhibited, and thus all of heat resistant storage stability, low temperature fixing ability, image glossiness, and hot offset resistance of the toner can be achieved.

<Polyester Resin>

The polyester resin has a structure represented by any one of the formulas 1) to 3), and has a structure obtained by combining R2 that is a polyester resin part or a modified polyester part with R1 corresponding to a branched structure via a urethane bond or a urea group.

The polyester resin has at least one of a urethane bond and a urea bond in the branched structure, and thus the urethane bond or the urea bond exhibits behaviors like pseudo-crosslinked points. Therefore, the polyester resin exhibits rubber-like properties, and thus a toner excellent in heat resistant storage stability and hot offset resistance can be produced.

The polyester resin contains a diol component as a constituent component, and preferably contains a dicarboxylic acid component as a constituent component.

The polyester resin is preferably a non-crystalline polyester resin.

The polyester resin is not particularly limited and may be appropriately selected depending on the intended purpose, so long as it is obtained by combining R2 corresponding to the polyester part or the modified polyester part with R1 corresponding to the branched structure via a urethane bond or a urea bond.

Methods for combining the R1 with the R2 are, for example, the following three methods, but are not limited thereto.

a) A method for reacting polyester polyol (R2) with trivalent or higher isocyanate (R1), where the polyester polyol (R2), which has a hydroxyl group at the end of the chain, is obtained by reacting a diol component with a dicarboxylic acid component through an ester reaction.

b) A method for reacting isocyanate-modified polyester (R2) with trihydric or higher alcohol (R1), where the isocyanate-modified polyester (R2) is obtained by reacting polyester polyol (R2) with bivalent polyisocyanate, where the polyester polyol (R2), which has a hydroxyl group at the end of the chain, is produced by reacting a diol component with a dicarboxylic acid component through an ester reaction.

c) A method for reacting isocyanate-modified polyester (R2) with trivalent or higher polyisocyanate (R1) in the presence of pure water, where the isocyanate-modified polyester (R2) is produced by reacting polyester polyol (R2) with bivalent polyisocyanate, where the polyester polyol (R2), which has a hydroxyl group at the end of the chain, is obtained by reacting a diol component with a dicarboxylic acid component through an ester reaction.

The hydroxyl group remaining in the polyol obtained by any one of the aforementioned methods a) to c) is further reacted with bivalent or more polyisocyanate, to thereby form polyester prepolymer. The polyester prepolymer can be used by reaction with a curing agent through a toner-producing process.

In the toner-producing process, a urethane bond or a urea bond is formed by reacting the resultant polyester prepolymer with a curing agent, and thus the urethane bond or the urea bond exhibits behaviors like strong cross-linking point. Therefore, the polyester resin exhibits strong rubber-like properties, and the resultant toner is further excellent in heat resistant storage stability and hot offset resistance. It is preferable that a portion corresponding to R2 be a modified polyester obtained by modifying polyester with isocyanate.

In order to lower a Tg of the polyester resin and in order to easily impart property of deforming at a low temperature, the polyester resin contains a diol component as a constituent component, and the diol component preferably contains an aliphatic diol having 3 to 12 carbon atoms, more preferably contains an aliphatic diol having 4 to 12 carbon atoms.

The polyester resin preferably includes the aliphatic diol having 3 to 12 carbon atoms in an amount of 50 mol % or more, more preferably includes the aliphatic diol having 3 to 12 carbon atoms in an amount of 80 mol % or more, still more preferably includes the aliphatic diol having 3 to 12 carbon atoms in an amount of 90 mol % or more.

Examples of the aliphatic diol having 3 to 12 carbon atoms include 1,3-propanediol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol.

In particular, in the polyester resin, it is more preferable that the diol component is an aliphatic diol having 4 to 12 carbon atoms, that a portion of the diol component to be a main chain has an odd number of carbon atoms, and that the diol component contains an alkyl group in a side chain of the diol component.

One example of the aliphatic diol having 4 to 12 carbon atoms, which contains an alkyl group in a side chain thereof, and includes the portion of the aliphatic diol to be a main chain having an odd number of carbon atoms, is an aliphatic diol represented by General Formula (1) below.

$$HO—(CR^1R^2)_n—OH \qquad \text{General Formula (1)}$$

Here, in the General Formula (1), $R^1$ and $R^2$ each independently represent a hydrogen atom and an alkyl group having 1 to 3 carbon atoms. n represents an odd number that is from 3 to 9. In units repeated n times, $R^1$ may be identical or different. In units represented n times, $R^2$ may be identical or different.

In order to lower a Tg of the polyester resin and in order to easily impart property of deforming at a low temperature, the polyester resin preferably contains an aliphatic diol having 3 to 12 carbon atoms in an amount of 50 mol % or more in the total alcohol component.

In order to lower a Tg of the polyester resin and in order to easily impart property of deforming at a low temperature, it is preferable that the polyester resin contains a dicarboxylic acid component as a constituent component, and the dicarboxylic acid component contains an aliphatic dicarboxylic acid having 4 to 12 carbon atoms.

The polyester resin preferably contains the aliphatic dicarboxylic acid having 4 to 12 carbon atoms in an amount of 30 mol % or more.

Examples of the aliphatic dicarboxylic acid having 4 to 12 carbon atoms include succinic acid, glutaric acid, adipic acid, pimelic acid, suberic acid, azelaic acid, sebacic acid, and dodecanedioic acid.

Diol Component

The diol component is not particularly limited and may be appropriately selected depending on the intended purpose. Examples thereof include aliphatic diols such as ethylene glycol, 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol; diols containing an oxyalkylene group such as diethylene glycol, triethylene glycol, dipropylene glycol, polyethylene glycol, polypropylene glycol and polytetramethylene glycol; alicyclic diols such as 1,4-cyclohexane dimethanol and hydrogenated bisphenol A; adducts of alicyclic diols with alkylene oxides such as ethylene oxide, propylene oxide, and butylene oxide; bisphenols such as bisphenol A, bisphenol F and bisphenol S; and adducts of bisphenols with alkylene oxides such as ethylene oxide, propylene oxide, and butylene oxide. Among them, aliphatic diols having 4 to 12 carbon atoms are preferred.

These diols may be used alone or in combination of two or more thereof.

Dicarboxylic Acid Component

The dicarboxylic acid component is not particularly limited and may be appropriately selected depending on the intended purpose. Examples thereof include aliphatic dicarboxylic acids and aromatic dicarboxylic acids. Besides, anhydrides thereof, lower (having 1 to 3 carbon atoms) alkyl-esterified compounds thereof, or halides thereof may also be used.

The aliphatic dicarboxylic acid is not particularly limited and may be appropriately selected depending on the intended purpose. Examples thereof include succinic acid, adipic acid, sebacic acid, decanedioic acid, maleic acid, and fumaric acid.

The aromatic dicarboxylic acid is not particularly limited and may be appropriately selected depending on the intended purpose, but it is preferably an aromatic dicarboxylic acid having 8 to 20 carbon atoms.

Examples of the aromatic dicarboxylic acid having 8 to 20 carbon atoms are not particularly limited and may be appropriately selected depending on the intended purpose. Examples thereof include phthalic acid, isophthalic acid, terephthalic acid, and naphthalene dicarboxylic acid.

Among them, an aliphatic dicarboxylic acids having 4 to 12 carbon atoms are preferable.

These dicarboxylic acids may be used alone or in combination of two or more thereof.

Trihydric or Higher Alcohol

The trihydric or higher alcohol is not particularly limited and may be appropriately selected depending on the intended purpose. Examples thereof include trihydric or higher aliphatic alcohols, trivalent or higher polyphenols, and adducts of alkylene oxide with trivalent or higher polyphenols.

Examples of the trihydric or higher aliphatic alcohol include glycerin, trimethylolethane, trimethylolpropane, pentaerythritol, and sorbitol.

Examples of trivalent or higher polyphenols include trisphenol PA, phenol novolak, and cresol novolak.

Examples of the adducts of alkylene oxide with trivalent or higher polyphenols include adducts of trivalent or higher polyphenols with alkylene oxides such as ethylene oxide, propylene oxide, and butylene oxide.

Polyisocyanate

The polyisocyanate is not particularly limited and may be appropriately selected depending on the intended purpose. Examples thereof include diisocyanate, and trivalent or higher isocyanate.

Examples of the diisocyanate include: aliphatic diisocyanate; alicyclic diisocyanate; aromatic diisocyanate; aromatic aliphatic diisocyanate; isocyanurate; and a block product thereof where the foregoing compounds are blocked with a phenol derivative, oxime, or caprolactam.

Examples of the trivalent or higher isocyanate include lysine triisocyanate, a compound obtained by reacting trihydric or higher alcohol with diisocyanate, and a compound isocyanurated by reacting with polyisocyanate.

Among them, polyisocyanate containing an isocyanurate skeleton is more preferably used, since it acts as stronger cross-linking point, and the toner is more excellent in heat resistant storage stability and hot offset resistance.

An amount of the trivalent isocyanate component is preferably 0.2 mol % to 1.0 mol %, relative to resin components in the THF insoluble matter of the toner. In cases where a cross-linked structure is formed by the trivalent isocyanate component, aggregation force of molecular chains increases by a pseudo-crosslinking caused by the urethane bond or the urea bond in the cross-linking point. Therefore, even if the cross-linking density is low, heat resistant storage stability of the toner can be improved, and thus low temperature fixing ability of the toner can be achieved at high level. When the amount of the trivalent isocyanate component is less than 0.2 mol %, formation of the branched structure may be insufficient. As a result, a portion having an ununiform network structure acts as a starting point, and thus the toner may be deteriorated in heat resistant storage stability and filming resistance. When the amount thereof is more than 1.0 mol %, a tight cross-linked structure is formed, and thus the toner may be deteriorated in low temperature fixing ability.

The aliphatic diisocyanate is not particularly limited and may be appropriately selected depending on the intended purpose. Examples thereof include tetramethylene diisocyanate, hexamethylene diisocyanate, 2,6-diisocyanato methyl caproate, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanate is not particularly limited and may be appropriately selected depending on the intended purpose. Examples thereof include isophorone diisocyanate, and cyclohexylmethane diisocyanate.

The aromatic diisocyanate is not particularly limited and may be appropriately selected depending on the intended purpose. Examples thereof include tolylene diisocyanate, diisocyanato diphenyl methane, 1,5-nephthylene diisocyanate, 4,4'-diisocyanato diphenyl, 4,4'-diisocyanato-3,3'-dimethyldiphenyl, 4,4'-diisocyanato-3-methyldiphenyl methane, and 4,4'-diisocyanato-diphenyl ether. The aromatic aliphatic diisocyanate is not particularly limited and may be appropriately selected depending on the intended purpose. Examples thereof include a,a,a',a'-tetramethylxylene diisocyanate.

The isocyanurate is not particularly limited and may be appropriately selected depending on the intended purpose. Examples thereof include tris(isocyanatoalkyl)isocyanurate, and tris(isocyanatocycloalkyl)isocyanurate.

These polyisocyanates may be used alone or in combination of two or more thereof.

Curing Agent

The curing agent is not particularly limited and may be appropriately selected depending on the intended purpose, so long as it can react with a polyester prepolymer (a reaction product of the polyester part corresponding to the R2 and the polyisocyanate, i.e., a reaction precursor that is allowed to react with the curing agent) to thereby produce the polyester resin. Examples thereof include an active hydrogen group-containing compound.

Active Hydrogen Group-Containing Compound

An active hydrogen group in the active hydrogen group-containing compound is not particularly limited and may be appropriately selected depending on the intended purpose. Examples thereof include a hydroxyl group (e.g., an alcoholic hydroxyl group, and a phenolic hydroxyl group), an amino group, a carboxyl group, and a mercapto group. These may be used alone or in combination of two or more thereof.

The active hydrogen group-containing compound is not particularly limited and may be appropriately selected depending on the intended purpose, but it is preferably amines, because it can form a urea bond.

The amines are not particularly limited and may be appropriately selected depending on the intended purpose. Examples thereof include diamine, trivalent or higher amine, amino alcohol, amino mercaptan, amino acid, and compounds in which the amino groups of the foregoing compounds are blocked. These may be used alone or in combination of two or more thereof.

Among them, diamine, and a mixture of diamine and a small amount of trivalent or higher amine are preferable.

The diamine is not particularly limited and may be appropriately selected depending on the intended purpose. Examples thereof include aromatic diamine, alicyclic diamine, and aliphatic diamine. The aromatic diamine is not particularly limited and may be appropriately selected depending on the intended purpose. Examples thereof include phenylenediamine, diethyl toluene diamine, and 4,4'-diaminodiphenylmethane. The alicyclic diamine is not particularly limited and may be appropriately selected depending on the intended purpose. Examples thereof include 4,4'-diamino-3,3'-dimethyldicyclohexyl methane, diamino cyclohexane, and isophoronediamine. The aliphatic diamine is not particularly limited and may be appropriately selected depending on the intended purpose. Examples thereof include ethylene diamine, tetramethylene diamine, and hexamethylenediamine.

The trivalent or higher amine is not particularly limited and may be appropriately selected depending on the intended purpose. Examples thereof include diethylenetriamine, and triethylene tetramine.

The amino alcohol is not particularly limited and may be appropriately selected depending on the intended purpose. Examples thereof include ethanol amine, and hydroxyethyl aniline.

The aminomercaptan is not particularly limited and may be appropriately selected depending on the intended purpose. Examples thereof include aminoethyl mercaptan, and aminopropyl mercaptan.

The amino acid is not particularly limited and may be appropriately selected depending on the intended purpose. Examples thereof include aminopropionic acid, and aminocaproic acid.

The compound where the amino group is blocked is not particularly limited and may be appropriately selected depending on the intended purpose. Examples thereof include a ketimine compound where the amino group is blocked with ketone such as acetone, methyl ethyl ketone, methyl isobutyl ketone, and an oxazoline compound.

A glass transition temperature of the polyester resin is preferably −60° C. to 0° C., more preferably −40° C. to −20° C.

When the glass transition temperature thereof is less than −60° C., the flow of the toner at a low temperature cannot be inhibited, heat resistant storage stability of the toner may be impaired, and filming resistance of the toner may be also impaired.

When the glass transition temperature thereof is more than 0° C., deformation of the toner with heat and pressurization during fixing is insufficient, which may lead to insufficient low temperature fixing ability of the toner.

In the polyester resin represented by any one of formulas 1) to 3), R1 preferably includes an isocyanurate skeleton represented by formula (I) below in terms of heat resistant storage stability and hot offset resistance of the toner.

[Chem. 1]

(I)

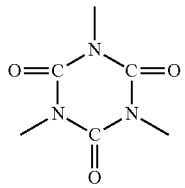

In the polyester resin represented by the above formulas 1) to 3), although detailed reasons have not been revealed, n is more preferably 3, because the three-dimensional network structure of the molecules causes a state suitable for all of low temperature fixing ability, image glossiness, heat resistant storage stability, and offset resistance.

Moreover, regarding the polyester resin, it is preferable that an organic group of R1 in the above formulas 1) to 3) be constituted of a small number of carbon atoms because a network structure is easier to make uniform, and that the organic group thereof be an aliphatic organic group or an aromatic organic group having 20 or less carbon atoms.

The organic group of R1 may include an ester bond.

Among them, as the organic group of R1, an aliphatic compound or an aliphatic compound containing an ester bond is preferable because aggregation force of a crosslinking point can be adjusted within an appropriate range, and both high glossiness and heat resistant storage stability of the resultant toner can be achieved.

A weight average molecular weight of the polyester resin is not particularly limited and may be appropriately selected depending on the intended purpose, but it is preferably 20,000 to 1,000,000 as measured by GPC (gel permeation chromatography).

The weight average molecular weight of the polyester resin is a molecular weight of a reaction product obtained by the reacting reactive precursor with the curing agent.

When the weight average molecular weight thereof is less than 20,000, the resultant toner may flow at a low temperature, and heat resistant storage stability of the toner may be deteriorated.

Moreover, viscosity of the toner during melting may be lowered, and heat resistant storage stability of the resultant toner may be deteriorated.

The polyester resin of the present invention may contain a polyester resin having the structure represented by any one of the formulas 1) to 3). The polyester resin having the structure represented by any one of the formulas 1) to 3) may be used alone or in combination with another polyester resin (referred to as a second polyester resin) other than the polyester resin having the structure represented by any one of the formulas 1) to 3) (referred to as a first polyester resin).

<<Another Polyester Resin>>

The another polyester resin (second polyester resin) contains, for example, a diol component and a dicarboxylic acid component as constituent components.

The another polyester resin is a polyester resin that is different from the polyester resin having the structure represented by any one of the formulas 1) to 3).

The another polyester resin is preferably a non-crystalline polyester resin.

Moreover, the another polyester resin is preferably a linear polyester resin.

Furthermore, the another polyester resin is preferably an unmodified polyester resin.

Note that, the unmodified polyester resin is a polyester resin that is obtained by using a polyhydric alcohol, and a multivalent carboxylic acid or derivatives thereof such as a multivalent carboxylic acid, a multivalent carboxylic acid anhydride, and a multivalent carboxylic acid ester, and that is not modified by an isocyanate compound and the like.

Examples of the polyhydric alcohol include diol.

The diol include alkylene (having 2 to 3 carbon atoms) oxide (average addition molar number is 1 to 10) adduct of bisphenol A such as polyoxypropylene(2.2)-2,2-bis(4-hydroxyphenyl)propane, and polyoxyethylene(2.2)-2,2-bis(4-hydroxyphenyl)propane; ethylenegrycol, propylenegrycol; and hydrogenated bisphenol A, and alkylene (having 2 to 3 carbon atoms) oxide (average addition molar number is 1 to 10) adduct of hydrogenated bisphenol A.

These may be used alone or in combination of two or more thereof.

Examples of the multivalent carboxylic acid include dicarboxylic acid. Examples of the dicarboxylic acid include: adipic acid, phthalic acid, isophthalic acid, terephthalic acid, fumaric acid, maleic acid; and succinic acid substituted by an alkyl group having 1 to 20 carbon atoms or an alkenyl group having 2 to 20 carbon atoms such as dodecenylsuccinic acid and octylsuccinic acid.

These may be used alone or in combination of two or more thereof.

The another polyester resin may contain at least one of a trivalent or higher carboxylic acid and a trihydric or higher alcohol at the end of the resin chain in order to adjust an acid value and a hydroxyl value.

Examples of the trivalent or higher carboxylic acid include trimellitic acid, pyromellitic acid, and acid anhydride thereof.

Examples of the trihydric or higher alcohol include glycerin, pentaerythritol, and trymethylol propane.

A molecular weight of the another polyester resin is not particularly limited and may be appropriately selected depending on the intended purpose. However, when the molecular weight thereof is too low, heat resistant storage stability of the toner and durability against stress such as stirring in the developing unit may be deteriorated. When the molecular weight thereof is too high, viscoelasticity of the toner during melting may be high, and thus low temperature fixing ability of the toner may be deteriorated. Thus, a weight average molecular weight (Mw) of the another polyester resin is preferably 3,000 to 10,000 as measured by GPC (gel permeation chromatography). A number average molecular weight (Mn) of the another polyester resin is preferably 1,000 to 4,000.

Moreover, a Mw/Mn of the another polyester resin is preferably 1.0 to 4.0.

The weight average molecular weight (Mw) thereof is more preferably 4,000 to 7,000. The number average molecular weight (Mn) thereof is more preferably 1,500 to 3,000. The Mw/Mn thereof is more preferably 1.0 to 3.5.

An acid value of the another polyester resin is not particularly limited and may be appropriately selected depending on the intended purpose, but it is preferably 1 mg KOH/g to 50 mg KOH/g, more preferably 5 mg KOH/g to 30 mg KOH/g.

When the acid value thereof is 1 mg KOH/g or more, the resultant toner may be negatively charged. In addition, the resultant toner has good affinity between paper and the toner when fixed on the paper, and thus low temperature fixing ability of the toner may be improved.

Meanwhile, when the acid value is more than 50 mg KOH/g, the resultant toner may be deteriorated in charging stability, especially charging stability against environmental change.

A hydroxyl value of the another polyester resin is not particularly limited and may be appropriately selected depending on the intended purpose. The hydroxyl value thereof is preferably 5 mg KOH/g or more.

A glass transition temperature (Tg) of the another polyester resins is preferably 40° C. to 70° C., more preferably 50° C. to 60° C.

When the glass transition temperature thereof is less than 40° C., the resultant toner may be deteriorated in heat resistant storage stability and durability against stress such as stiffing in the developing unit, and the resultant toner may be deteriorated in filming resistance.

Meanwhile, when the glass transition temperature thereof is more than 70° C., the deformation of the toner with heat and pressurization during fixing may be not sufficient, which leads to insufficient low temperature fixing ability.

A molecular structure of the polyester resin (in both a case where the polyester resin having the structure represented by any one of the formulas 1) to 3) is used alone; and a case where it is used in combination with another polyester resin) can be confirmed by solution-state or solid-state NMR, X-ray diffraction, GC/MS, LC/MS, or IR spectroscopy. Simple methods for confirming the molecular structure thereof include a method for detecting, as the polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the polyester resin (in both a case where the polyester resin having the structure represented by any one of the formulas 1) to 3) is used alone; and a case where it is used in combination with the another polyester resin) is not particularly limited and may be appropriately selected depending on the intended purpose. When the polyester resin contains two kinds of polyester resins: the polyester resin having the structure represented by any one of the formulas 1) to 3); and the another polyester resin, an amount of the polyester resin having the structure represented by any one of the formulas 1) to 3) is preferably 5 parts by mass to 25 parts by mass, more preferably 10 parts by mass to 20 parts by mass, relative to 100 parts by mass of the toner. When the amount thereof is less than 5 parts by mass, the toner may be deteriorated in low temperature fixing ability and hot offset resistance. When it is more than 25 parts by mass, the toner may be deteriorated in heat resistant storage stability and glossiness of an image obtained after fixing. The amount thereof falling within the more preferable range is advantageous in that the resultant toner is excellent in all of the low temperature fixing ability, hot offset resistance, and heat resistant storage stability.

Meanwhile, an amount of the another polyester resin is preferably 50 parts by mass to 90 parts by mass, more preferably 60 parts by mass to 80 parts by mass, relative to 100 parts by mass of the toner. When the amount thereof is less than 50 parts by mass, dispersibility of the colorant and the release agent in the toner may be deteriorated, and fogging and artifacting of an image may be caused. When it is more than 90 parts by mass, an amount of the crystalline polyester resin described hereinafter or the polyester resin having the structure represented by any one of the formulas 1) to 3) is lower, and thus the toner may be deteriorated in low temperature fixing ability. The amount thereof falling within the more preferable range is advantageous in that the toner is excellent in both high image and low temperature fixing ability.

<Crystalline Polyester Resin>

Crystalline polyester resin exhibits heat melting characteristics where it causes drastic viscosity lowering at temperature around fixing onset temperature, since it has high crystallinity. By using the crystalline polyester resin having these characteristics together with the polyester resin, the heat resistant storage stability of the toner is excellent up to the melt onset temperature owing to crystallinity, and the toner drastically decreases its viscosity at the melt onset temperature because of melting of the crystalline polyester resin. Along with the drastic decrease in viscosity, the crystalline polyester resin melts together with the polyester resin, to drastically decrease their viscosity to thereby be fixed. Accordingly, a toner having excellent heat resistant storage stability and low temperature fixing ability can be obtained. Moreover, the toner has excellent results in terms of a releasing width (a difference between the minimum fixing temperature and hot offset occurring temperature).

The crystalline polyester resin is obtained from a polyhydric alcohol and a multivalent carboxylic acid or a derivative thereof such as a multivalent carboxylic acid anhydride and a multivalent carboxylic acid ester.

Note that, in the present invention, the crystalline polyester resin is one obtained by using a polyhydric alcohol, and a multivalent carboxylic acid or derivatives thereof such as a multivalent carboxylic acid, a multivalent carboxylic acid anhydride, and a multivalent carboxylic acid ester, as described above, and a product obtained by modifying a polyester resin (for example, the prepolymer, and a resin obtained through cross-linking and/or chain elongation reaction of the aforementioned prepolymer) do not belong to the crystalline polyester resin.

Presence of crystallinity of the crystalline polyester resin of the present invention can be confirmed using a crystal analysis X-ray diffraction device (for example, X' PERT PRO MRD, product of Philips). Measurement method is described hereinafter.

First, a sample is ground in a mortar, to thereby obtain a sample powder. The obtained sample powder is uniformly coated on a sample holder. Then, the sample holder is set to the diffraction device, and is measured, to thereby obtain diffraction spectrum.

When, in the peaks obtained within a range of $20° < 2\theta < 25°$ in the obtained diffraction peaks, a peak half value width of a peak having the largest peak intensity is 2.0 or less, it is judged to have crystallinity.

In the present invention, a polyester resin that does not exhibit the above condition is referred to as a non-crystalline polyester resin, compared to the crystalline polyester resin.

Measurement conditions of X-ray diffraction are described as follows.

Measurement Conditions
Tension kV: 45 kV
Current: 40 mA
MPSS
Upper
Gonio
Scanmode: continuos
Start angle: 3°
End angle: 35°
Angle Step: 0.02°
Lucident beam optics
Divergence slit: Div slit ½
Deflection beam optics
Anti scatter slit: As Fixed ½
Receiving slit: Prog rec slit Polyhydric Alcohol The polyhydric alcohol is not particularly limited and may be appropriately selected depending on the intended purpose. Examples thereof include diol, and trihydric or higher alcohol.

Examples of the diol include saturated aliphatic diol. Examples of the saturated aliphatic diol include straight chain saturated aliphatic diol, and branched-chain saturated aliphatic diol. Among them, straight chain saturated aliphatic diol is preferable, and straight chain saturated aliphatic diol having 2 to 12 carbon atoms is more preferable. When the saturated aliphatic diol has a branched-chain structure, crystallinity of the crystalline polyester resin may be low, and thus may lower the melting point. When the number of carbon atoms in the saturated aliphatic diol is more than 12, it may be difficult to yield a material in practice. The number of carbon atoms is preferably 12 or less.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, ethylene glycol, 1,4-butanediol, 1,6-hexanediol, 1,8-octanediol, 1,10-decanediol, and 1,12-dodecanediol are preferable, as they give high crystallinity to a resulting crystalline polyester resin, and give excellent sharp melt properties.

Examples of the trihydric or higher alcohol include glycerin, trimethylol ethane, trimethylolpropane, and pentaerythritol. These may be used alone or in combination of two or more thereof.

Multivalent Carboxylic Acid

The multivalent carboxylic acid is not particularly limited and may be appropriately selected depending on the intended purpose. Examples thereof include divalent carboxylic acid, and trivalent or higher carboxylic acid.

Examples of the divalent carboxylic acid include: saturated aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acid of dibasic acid, such as phthalic acid, isophthalic acid, terephthalic acid, naphthalene-2,6-dicarboxylic acid, malonic acid, and mesaconic acid; and anhydrides of the foregoing compounds, and lower (having 1 to 3 carbon atoms) alkyl ester of the foregoing compounds.

Examples of the trivalent or higher carboxylic acid include 1,2,4-benzenetricarboxylic acid, 1,2,5-benzenetricarboxylic acid, 1,2,4-naphthalene tricarboxylic acid, anhydrides thereof, and lower (having 1 to 3 carbon atoms) alkyl esters thereof.

Moreover, the multivalent carboxylic acid may contain, other than the saturated aliphatic dicarboxylic acid or aromatic dicarboxylic acid, dicarboxylic acid containing a sulfonic acid group. Further, the multivalent carboxylic acid may contain, other than the saturated aliphatic dicarboxylic acid or aromatic dicarboxylic acid, dicarboxylic acid having a double bond. These may be used alone or in combination of two or more thereof.

The crystalline polyester resin is preferably composed of a straight chain saturated aliphatic dicarboxylic acid having 4 to 12 carbon atoms and a straight chain saturated aliphatic diol having 2 to 12 carbon atoms. Specifically, the crystalline polyester resin preferably contains a constituent unit derived from a saturated aliphatic dicarboxylic acid having 4 to 12 carbon atoms, and a constituent unit derived from a saturated aliphatic diol having 2 to 12 carbon atoms. As a result of this, crystallinity increases, and sharp melt properties improves, and therefore it is preferable as excellent low temperature fixing ability of the toner is exhibited.

A melting point of the crystalline polyester resin is not particularly limited and may be appropriately selected depending on the intended purpose, but it is preferably 60° C. to 80° C. When the melting point thereof is less than 60° C., the crystalline polyester resin tends to melt at low temperature, which may impair heat resistant storage stability of the toner. When the melting point thereof is more than 80° C., melting of the crystalline polyester resin with heat applied during fixing may be insufficient, which may impair low temperature fixing ability of the toner.

A molecular weight of the crystalline polyester resin is not particularly limited and may be appropriately selected depending on the intended purpose. Since those having a sharp molecular weight distribution and low molecular weight have excellent low temperature fixing ability, and heat resistant storage stability of the resultant toner lowers as an amount of a low molecular weight component, an o-dichlorobenzene soluble component of the crystalline polyester resin preferably has the weight average molecular weight (Mw) of 3,000 to 30,000, number average molecular weight (Mn) of 1,000 to 10,000, and Mw/Mn of 1.0 to 10, as measured by GPC. Further, it is more preferred that the weight average molecular weight (Mw) thereof be 5,000 to 15,000, the number average molecular weight (Mn) thereof be 2,000 to 10,000, and the Mw/Mn be 1.0 to 5.0.

An acid value of the crystalline polyester resin is not particularly limited and may be appropriately selected depending on the intended purpose, but it is preferably 5 mg KOH/g or more, more preferably 10 mg KOH/g or more for achieving the desired low temperature fixing ability in view of affinity between paper and the resin. Meanwhile, the acid value thereof is preferably 45 mg KOH/g or lower for the purpose of improving hot offset resistance.

A hydroxyl value of the crystalline polyester resin is not particularly limited and may be appropriately selected depending on the intended purpose. However, it is preferably 0 mg KOH/g to 50 mg KOH/g, more preferably 5 mg KOH/g to 50 mg KOH/g, in order to achieve the desired low temperature fixing ability and excellent charging property.

A molecular structure of the crystalline polyester resin can be confirmed by solution-state or solid-state NMR, X-ray diffraction, GC/MS, LC/MS, or IR spectroscopy. Simple methods for confirming the molecular structure thereof include a method for detecting, as a crystalline polyester resin, one that has absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the crystalline polyester resin is not particularly limited and may be appropriately selected depending on the intended purpose, but it is preferably 3 parts by mass to 20 parts by mass, more preferably 5 parts by mass to 15 parts by mass, relative to 100 parts by mass of the toner. When the amount thereof is less than 3 parts by mass, the crystalline polyester resin is insufficient in sharp melt property, and thus the resultant may be deteriorated in heat resistant storage stability. When it is more than 20 parts by mass, the resultant toner may be deteriorated in heat resistant storage stability, and fogging of an image may be caused. When the amount thereof is within more preferable range than the aforementioned range, it is advantageous that the resultant toner is excellent in both high image quality and low temperature fixing ability.

<Other Components>

Examples of the aforementioned other components include a release agent, a colorant, a charge controlling agent, an external additive, a flow improving agent, a cleaning improving agent, and a magnetic material.

Release Agent

The release agent is appropriately selected from those known in the art without any limitation.

Examples of wax serving as the release agent include: natural wax, such as vegetable wax (e.g., carnauba wax, cotton wax, Japan wax and rice wax), animal wax (e.g., bees wax and lanolin), mineral wax (e.g., ozokelite and ceresine) and petroleum wax (e.g., paraffin wax, microcrystalline wax and petrolatum).

Examples of the wax other than the above natural wax include a synthetic hydrocarbon wax (e.g., Fischer-Tropsch wax and polyethylene wax; and a synthetic wax (e.g., ester wax, ketone wax and ether wax).

Further, other examples of the release agent include fatty acid amides such as 12-hydroxystearic acid amide, stearic amide, phthalic anhydride imide and chlorinated hydrocarbons; low-molecular-weight crystalline polymers such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain of the diol component.

Among them, a hydrocarbon wax, such as a paraffin wax, a microcrystalline wax, a Fischer-Tropsch wax, a polyethylene wax, and a polypropylene wax, is preferable.

A melting point of the release agent is not particularly limited and may be appropriately selected depending on the intended purpose, but it is preferably 60° C. to 80° C. When the melting point thereof is less than 60° C., the release agent tends to melt at low temperature, which may impair heat resistant storage stability. When the melting point thereof is more than 80° C., the release agent does not sufficiently melt to thereby cause fixing offset, even in the case where the resin is in the fixing temperature range, which may cause defects in an image.

An amount of the release agent is appropriately selected depending on the intended purpose without any limitation, but it is preferably 2 parts by mass to 10 parts by mass, more preferably 3 parts by mass to 8 parts by mass, relative to 100 parts by mass of the toner. When the amount thereof is less than 2 parts by mass, the resultant toner may have insufficient hot offset resistance, and low temperature fixing ability during fixing. When the amount thereof is more than 10 parts by mass, the resultant toner may have insufficient heat resistant storage stability, and tends to cause fogging in an image. When the amount thereof is within the aforementioned more preferable range, it is advantageous because image quality and fixing stability can be improved.

Colorant

The colorant is appropriately selected depending on the intended purpose without any limitation, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazine lake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

An amount of the colorant is not particularly limited and may be appropriately selected depending on the intended purpose, but it is preferably 1 part by mass to 15 parts by mass, more preferably 3 parts by mass to 10 parts by mass, relative to 100 parts by mass of the toner.

The colorant may be used as a master batch in which the colorant forms a composite with a resin. As a resin used in the production of the master batch or a resin kneaded together with the master batch, other than the another polyester resin, polymer of styrene or substitution thereof (e.g., polystyrene, poly-p-chlorostyrene, and polyvinyl toluene); styrene copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl a-chloromethacrylate copolymer, styrene-acrylonitrile copolymer, styrene-methyl vinyl ketone copolymer, styrene-butadiene copolymer, styrene-isoprene copolymer, styrene-acrylonitrile-indene copolymer, styrene-maleic acid copolymer, and styrene-maleic acid ester copolymer); and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax can be used. These may be used alone or in combination.

The master batch can be prepared by mixing and kneading the colorant with the resin for the master batch. In the mixing and kneading, an organic solvent may be used for improving the interactions between the colorant and the resin. Moreover, the master batch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant. In the mixing and kneading of the colorant and the resin, a high-shearing disperser (e.g., a three-roll mill) is preferably used.

Charge Controlling Agent

The charge controlling agent is not particularly limited and may be appropriately selected depending on the intended purpose. Examples thereof include a nigrosine-based dye, a triphenylmethane-based dye, a chromium-containing metallic complex dye, a molybdic acid chelate pigment, a rhodamine-based dry, alkoxy-based amine, a quarternary ammonium salt (including a fluorine-modified quarternary ammonium salt), alkylamide, a simple substance or a compound of phosphorus, a simple substance or a compound of tungsten, a fluorine-based activator, a salicylic acid metallic salt, and a metallic salt of salicylic acid derivative.

Specific examples thereof include: a nigrosine dye BONTRON 03, a quaternary ammonium salt BONTRON P-51, a metal-containing azo dye BONTRON S-34, an oxynaphthoic acid-based metal complex E-82, a salicylic acid-based metal complex E-84 and a phenol condensate E-89 (all products of ORIENT CHEMICAL INDUSTRIES CO., LTD.); quaternary ammonium salt molybdenum complexes TP-302 and TP-415 (all products of Hodogaya Chemical Co., Ltd.); LRA-901; a boron complex LR-147 (product of Japan Carlit Co., Ltd.); a copper phthalocyanine; perylene; quinacridone; an azo-pigment; and polymeric compounds having, as a functional group, a sulfonic acid group, carboxyl group, quaternary ammonium salt, etc.

An amount of the charge controlling agent is not particularly limited and may be appropriately selected depending on the intended purpose, but it is preferably 0.1 parts by mass to 10 parts by mass, more preferably 0.2 parts by mass to 5 parts by mass, relative to 100 parts by mass of the toner. When the amount thereof is more than 10 parts by mass, the charging ability of the toner becomes excessive, which may reduce the effect of the charge controlling agent, increase electrostatic force to a developing roller, leading to low flowability of the developer, or low image density of the resulting image. These charge controlling agents may be dissolved and dispersed after being melted and kneaded together with the master batch, and/or resin. The charge controlling agents can be, of course, directly added to an organic solvent when dissolution and dispersion is performed. Alternatively, the charge controlling agents may be fixed on surfaces of toner particles after the production of the toner particles.

External Additive

As for the external additive, other than oxide particles, a combination of inorganic particles and hydrophobic-treated inorganic particles can be used. The average particle diameter of primary particles of the hydrophobic-treated particles is preferably 1 nm to 100 nm, and more preferable 5 nm to 70 nm.

Moreover, it is preferred that the external additive contain at least one type of hydrophobic-treated inorganic particles having the average particle diameter of primary particles of 20 nm or less, and at least one type of inorganic particles having the average particle diameter of primary particles of 30 nm or more. Moreover, the external additive preferably has the BET specific surface area of 20 $m^2/g$ to 500 $m^2/g$.

The external additive is not particularly limited and may be appropriately selected depending on the intended purpose. Examples thereof include silica particles, hydrophobic silica, fatty acid metal salts (e.g., zinc stearate, and aluminum stearate), metal oxide (e.g., titania, alumina, tin oxide, and antimony oxide), and a fluoropolymer.

Examples of the suitable additive include hydrophobic silica, titania, titanium oxide, and alumina particles. Examples of the silica particles include R972, R974, RX200, RY200, R202, R805, and R812 (all products of Nippon Aerosil Co., Ltd.). Examples of the titania particles include P-25 (product of Nippon Aerosil Co., Ltd.); STT-30, STT-65C-S (both products of Titan Kogyo, Ltd.); TAF-140 (product of Fuji Titanium Industry Co., Ltd.); and MT-150W, MT-500B, MT-600B, MT-150A (all product of TAYCA CORPORATION).

Examples of the hydrophobic-treated titanium oxide particles include: T-805 (product of Nippon Aerosil Co., Ltd.); STT-30A, STT-65S-S (both products of Titan Kogyo, Ltd.); TAF-500T, TAF-1500T (both products of Fuji Titanium Industry Co., Ltd.); MT-100S, MT-100T (both products of TAYCA CORPORATION); and IT-S (product of ISHIHARA SANGYO KAISHA, LTD.).

The hydrophobic-treated oxide particles, hydrophobic-treated silica particles, hydrophobic-treated titania particles, and hydrophobic-treated alumina particles can be obtained, for example, by treating hydrophilic particles with a silane coupling agent, such as methyltrimethoxy silane, methyltriethoxy silane, and octyltrimethoxy silane. Moreover, silicone oil-treated oxide particles, or silicone oil-treated inorganic particles, which have been treated by adding silicone oil optionally with heat, are also suitably used as the external additive.

Examples of the silicone oil include dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and α-methylstyrene-modified silicone oil.

Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica and titanium dioxide are preferable.

An amount of the external additive is not particularly limited and may be appropriately selected depending on the intended purpose, but it is preferably 0.1 parts by mass to 5 parts by mass, more preferably 0.3 parts by mass to 3 parts by mass, relative to 100 parts by mass of the toner.

The average particle diameter of primary particles of the inorganic particles is not particularly limited and may be appropriately selected depending on the intended purpose, but it is preferably 100 nm or less, more preferably 3 nm to 70 nm. When the average particle diameter thereof is within the aforementioned range, the inorganic particles are embedded in the toner particles, and therefore the function of the inorganic particles may not be effectively exhibited. When it exceeds the aforementioned range, the inorganic particles may unevenly damage a surface of a photoconductor, and hence not preferable.

Flowability Improving Agent

The flowability improving agent is not particularly limited and may be appropriately selected depending on the intended purpose so long as it is capable of performing surface treatment of the toner to increase hydrophobicity, and preventing degradations of flow properties and charging properties of the toner even in a high humidity environment. Examples thereof include a silane-coupling agent, a sililation agent, a silane-coupling agent containing a fluoroalkyl group, an organic titanate-based coupling agent, an aluminum-based coupling agent, silicone oil, and modified silicone oil. It is particularly preferred that the silica or the titanium oxide be used as hydrophobic silica or hydrophobic titanium oxide treated with the aforementioned flow improving agent.

Cleanability Improving Agent

The cleanability improving agent is not particularly limited and may be appropriately selected depending on the intended purpose so long as it can be added to the toner for the purpose of removing the developer remaining on a photoconductor or a primary transfer member after transferring. Examples thereof include: fatty acid metal salt such as zinc stearate, calcium stearate, and stearic acid; and polymer particles produced by soap-free emulsion polymerization, such as polymethyl methacrylate particles, and polystyrene particles. The polymer particles are preferably those having a relatively narrow particle size distribution, and the polymer particles having the volume average particle diameter of 0.01 mm to 1 mm are preferably used.

Magnetic Material

The magnetic material is not particularly limited and may be appropriately selected depending on the intended purpose. Examples thereof include iron powder, magnetite, and ferrite. Among them, a white magnetic material is preferable in terms of a color tone.

<Glass Transition Temperature (Tg1st)>

A glass transition temperature (Tg1st) of the toner is preferably 20° C. to 50° C., where the glass transition temperature (Tg1st) is a glass transition temperature measured in first heating of differential scanning calorimetry (DSC) of the toner.

In conventional toners, when a Tg thereof is about 50° C. or less, the conventional toners tend to cause aggregation of toner particles because it is influenced by temperature variations during transportation or storage of the toner in summer or in a tropical region. As a result, the toner particles are solidified in a toner bottle, or adherence of the toner particles may be caused within a developing unit. Moreover, supply failures due to clogging of the toner in the toner bottle, and formation of defected images due to adherence of the toner may be caused.

A toner of the present invention tends to have a lower Tg than the conventional toners. However, the polyester resin having the structure represented by any one of the formulas 1) to 3) in the toner, which is a low Tg component, is non-linear. Thus, the toner of the present invention can retain heat resistant storage stability. In particular, when the polyester resin having the structure represented by any one of the formulas 1) to 3) has a urethane bond or a urea bond responsible for high aggregation force, the resultant toner may significantly exhibit more excellent effects in heat resistant storage stability.

When the Tg1st is less than 20° C., the toner may be deteriorated in heat resistant storage stability, and blocking within a developing unit and filming on a photoconductor may be caused. When the Tg1st is more than 50° C., low temperature fixing ability of the toner may be deteriorated.

As a preferable aspect of the present invention, the polyester resin contains two kinds of polyester resins: a polyester resin having the structure represented by any one of the formulas 1) to 3); and another polyester resin, where Tg1st of a toner containing the polyester resin is 20° C. to 50° C.

A difference (Tg1st-Tg2nd) is not particularly limited and may be appropriately selected depending on the intended purpose, but it is preferably 10° C. or more, where the Tg1st is a glass transition temperature measured in first heating of differential scanning calorimetry (DSC) of the toner, and the Tg2nd is a glass transition temperature measured in second heating of differential scanning calorimetry (DSC) of the toner. An upper limit of the difference is not particularly limited and may be appropriately selected depending on the intended purpose, but the difference (Tg1st-Tg2nd) is preferably 50° C. or less.

A preferable aspect of the present invention is an aspect where the polyester resin further contains a crystalline polyester resin, and a difference (Tg1st-Tg2nd) between the Tg1st and the Tg2nd of the toner containing these materials is 10° C. or more.

When the difference is 10° C. or more, it is advantageous that the toner is excellent in low temperature fixing ability. The difference of 10° C. or more means that the crystalline polyester resin and the polyester resin exist in a non-compatible state before heating (before the first heating), and then they exist in a compatible state after heating (after the first heating).

Note that, the compatible state after heating (after the first heating) may not be a completely compatible state.

A melting point of the toner is not particularly limited and may be appropriately selected depending on the intended purpose, but it is preferably 60° C. to 80° C.

<Volume Average Particle Diameter>

The volume average particle diameter of the toner is not particularly limited and may be appropriately selected depending on the intended purpose, but it is preferably 3 mm to 7 mm. Moreover, a ratio of the volume average particle diameter to the number average particle diameter is preferably 1.2 or less. Further, the toner preferably contains toner particles having the volume average particle diameter of 2 mm or less, in an amount of 1% by number to 10% by number.

<Calculation Methods and Analysis Methods of Various Properties of Toner and Constituent Component of Toner>

A SP value, a Tg, an acid value, a hydroxyl value, a molecular weight, and a melting point of the polyester resin, the crystalline polyester resin, and the release agent may be each measured. Alternatively, each component may be separated from an actual toner by gel permeation chromatography (GPC) or the like, and each of the separated components may be subjected to the analysis methods described hereinafter, to thereby determine physical properties such as a SP value, a Tg, a molecular weight, a melting point, and a mass ratio of constituent components.

Separation of each component by GPC can be performed, for example, by the following method.

In GPC measurement using THF (tetrahydrofuran) as a mobile phase, an eluate is subjected to fractionation by a fraction collector, a fraction corresponding to a part of a desired molecular weight is collected from a total area of an elution curve.

The combined eluate is concentrated and dried by an evaporator or the like, and a resulting solid content is dissolved in a deuterated solvent, such as deuterated chloroform, and deuterated THF, followed by measurement of $^{1}$H-NMR. From an integral ratio of each element, a ratio of a constituent monomer of the resin in the elution composition is calculated.

As another method, after concentrating the eluate, hydrolysis is performed with sodium hydroxide or the like, and a ratio of a constituent monomer is calculated by subjecting the decomposed product to a qualitative and quantitative analysis by high performance liquid chromatography (HPLC).

Note that, in the case where the toner is produced by generating the polyester resin through a chain-elongation reaction and/or crosslink reaction of the non-linear reactive precursor and the curing agent to thereby produce toner base particles, the polyester resin may be separated from an actual toner by GPC or the like, to thereby determine a Tg thereof. Alternatively, the toner may be produced by synthesizing the polyester resin through a chain-elongation reaction and/or crosslink reaction of the non-linear reactive precursor and the curing agent, to thereby measure a Tg thereof from the synthesized polyester resin.

<Separation Unit for Toner Constituent Components>

One example of a separation unit for each component during an analysis of the toner will be specifically explained hereinafter.

First, 1 g of a toner is added to 100 mL THF, and the resulting mixture is stirred for 30 minutes at 25° C., to thereby obtain a solution in which soluble components are dissolved.

The solution is then filtered through a membrane filter having an opening of 0.2 mm, to thereby obtain THF soluble matter in the toner.

Next, the THF soluble matter are dissolved in THF, to thereby prepare a sample for measurement of GPC, and the prepared sample is supplied to GPC used for molecular weight measurement of each resin mentioned above.

Meanwhile, a fraction collector is disposed at an eluate outlet of GPC, to fraction the eluate per a certain count. The eluate is obtained per 5% in terms of the area ratio from the elution onset on the elution curve (raise of the curve).

Next, each eluted fraction, as a sample, in an amount of 30 mg is dissolved in 1 mL of deuterated chloroform, and to this solution, 0.05% by volume of tetramethyl silane (TMS) is added as a standard material.

A glass tube for NMR having a diameter of 5 mm is charged with the solution, from which a spectrum is obtained by a nuclear magnetic resonance apparatus (JNM-AL 400, product of JEOL Ltd.) by performing multiplication 128 times at temperature of 23° C. to 25° C.

The monomer compositions and the compositional ratios of the polyester resin and the crystalline polyester resin in the toner are determined from peak integral ratios of the obtained spectrum.

For example, an assignment of a peak is performed in the following manner, and a constituent monomer component ratio is determined from each integral ratio.

The assignment of a peak is as follows:

Around 8.25 ppm: derived from a benzene ring of trimellitic acid (for one hydrogen atom)

Around the region of 8.07 ppm to 8.10 ppm: derived from a benzene ring of terephthalic acid (for four hydrogen atoms)

Around the region of 7.1 ppm to 7.25 ppm: derived from a benzene ring of bisphenol A (for four hydrogen atoms)

Around 6.8 ppm: derived from a benzene ring of bisphenol A (for four hydrogen atoms), and derived from a double bond of fumaric acid (for two hydrogen atoms)

Around the region of 5.2 ppm to 5.4 ppm: derived from methine of bisphenol A propylene oxide adduct (for one hydrogen atom)

Around the region of 3.7 ppm to 4.7 ppm: derived from methylene of a bisphenol A propylene oxide adduct (for two hydrogen atoms), and derived from methylene of a bisphenol A ethylene oxide adduct (for four hydrogen atoms)

Around 1.6 ppm: derived from a methyl group of bisphenol A (for six hydrogen atoms).

From these results, for example, an extracted product collected in a fraction containing the polyester resin having the structure represented by any one of the formulas 1) to 3) in an amount of 90% by mass or more can be treated as the polyester resin having the structure represented by any one of the formulas 1) to 3).

Similarly, the extracted product collected in a fraction containing the another polyester resin in an amount of 90% by mass or more can be treated as the another polyester resin.

The extracted product collected in a fraction containing the crystalline polyester resin in an amount of 90% by mass or more can be treated as the crystalline polyester resin.

<<Analysis of THF Insoluble Matter of the Toner>>

The THF insoluble matter of the toner can be extracted as follows, for example.

The toner (1 part) is added to 40 parts of THF, and the resultant mixture was refluxed for 6 hours. Then, an insoluble matter in the resultant mixture is allowed to precipitate by a centrifugal separator, and is separated into an insoluble component and a supernatant. The insoluble component is dried at 40° C. for 20 hours, to thereby obtain THF insoluble matter. The THF insoluble matter corresponds to a non-linear polyester resin. Accordingly, the THF insoluble matter contains a plurality of structural portions derived from trivalent isocyanate.

Composition of the THF insoluble matter can be analyzed by solution-state or solid-state NMR, X-ray diffraction, GC/MS, LC/MS, or IR spectroscopy.

As a simple method, the THF insoluble matter can be analyzed as follows by thermal decomposition simultaneously-methylated GC-MS method using a methylated reaction reagent.

Device name: QP2010 FRONTIER LAB Py2020D, product of SHIMADZU CORPORATION

Data analysis software: GCMS SOLUTION, product of SHIMADZU CORPORATION

Heating temperature: 280° C.

Reaction heat decomposition temperature: 300° C.

Name of column: ULTRA ALLOY-5 L=30 m ID=0.25 mm Film=0.25 μm

Temperature of thermostat chamber: 50° C. (retained for 1 minute) to 10° C./min to 330° C. (retained for 11 minutes)

Carrier gas: 53.6 kPa constant, He 1.0 mL/min

Injection mode: Split (1:100)

Ionization method: EI method (70 eV)

Measurement method: scan mode

Library: NIST 20 MASS SPECTRAL

<<Measurement Method for Hydroxyl Value and Acid Value>>

The hydroxyl value can be measured according to the method of JIS K0070-1966.

Specifically, 0.5 g of a sample is weighed and is added to a 100 mL-measuring flask, followed by adding 5 mL of an acetylating reagent thereto. After the resultant mixture is heated in a warm bath set to 100±5° C. for 1 to 2 hours, the flask is taken out from the warm bath and is cooled. Moreover, water is added thereto, and the flask is allowed to swing, to thereby decompose acetic anhydride.

Next, in order to completely decompose acetic anhydride, the flask is heated in a warm bath for 10 minutes or longer, and is cooled. Then, an inner wall of the flask is sufficiently washed with an organic solvent. Moreover, a potentiometric automatic titrator DL-53 (product of Mettler-Toledo K.K.) and an electrode DG113-SC (product of Mettler-Toledo K.K.) are used to measure the hydroxyl value at 23° C. The measurements are analyzed with analysis software LabX Light Version 1.00.000. The calibration for this apparatus is performed using a solvent mixture of toluene (120 mL) and ethanol (30 mL).

Here, measurement conditions are as follows.

Measurement Conditions

Stir

Speed [%] 25

Time [s] 15

EQP titration

Titrant/Sensor

Titrant $CH_3Ona$

Concentration [mol/L] 0.1

Sensor DG115

Unit of measurement mV

Predispensing to volume

Volume [mL] 1.0

Wait time [s] 0

Titrant addition Dynamic dE (set) [mV] 8.0 dV (min) [mL] 0.03 dV (max) [mL] 0.5

Measure mode Equilibrium controlled dE [mV] 0.5 dt [s] 1.0 t (min) [s] 2.0 t (max) [s] 20.0

Recognition

Threshold 100.0

Steepest jump only No

Range No

Tendency None

Termination at maximum volume[mL] 10.0 at potential No
at slope No
after number EQPs Yes
n=1
Comb. termination conditions No
Evaluation
Procedure Standard
Potential 1 No
Potential 2 No
Stop for reevaluation No The acid value can be measured according to the method of JIS K0070-1992. Specifically, first, 0.5 g of a sample (soluble matter in ethyl acetate: 0.3 g) is added to 120 mL of toluene, and the resultant mixture is stirred for about 10 hours at 23° C. for dissolution. Next, ethanol (30 mL) is added thereto to prepare a sample solution. Notably, when the sample is not dissolved in toluene, another solvent such as dioxane or tetrahydrofuran is used.

Then, a potentiometric automatic titrator DL-53 (product of Mettler-Toledo K.K.) and an electrode DG113-SC (product of Mettler-Toledo K.K.) are used to measure the acid value at 23° C. The measurements are analyzed with analysis software LabX Light Version 1.00.000. The calibration for this apparatus is performed using a solvent mixture of toluene (120 mL) and ethanol (30 mL).

Here, measurement conditions are the same as the aforementioned measurement conditions of the hydroxyl value.

The acid value can be measured in the above-described manner. Specifically, the sample solution is titrated with a pre-standardized 0.1N potassium hydroxide/alcohol solution and then the acid value is calculated from the titer using the equation: acid value (mg KOH/g)=titer (mL) ‘ N’ 56.1 (mg/mL)/mass of sample (g), where N is a factor of 0.1N potassium hydroxide/alcohol solution.

<<Measurement Methods of Melting Point and Glass Transition Temperature (Tg)>>

In the present invention, a melting point and a glass transition temperature (Tg) of the toner can be measured, for example, by a differential scanning calorimeter (DSC) system (Q-200, product of TA Instruments Japan Inc.).

Specifically, a melting point and a glass transition temperature of samples can be measured in the following manners.

Specifically, first, an aluminum sample container charged with about 5.0 mg of a sample is placed on a holder unit, and the holder unit is then set in an electric furnace. Next, the sample is heated (first heating) from −80° C. to 150° C. at the heating rate of 10° C./min in a nitrogen atmosphere. Then, the sample is cooled from 150° C. to −80° C. at the cooling rate of 10° C./min, followed by again heating (second heating) to 150° C. at the heating rate of 10° C./min. DSC curves are respectively measured for the first heating and the second heating by a differential scanning calorimeter (Q-200, product of TA Instruments Japan Inc.).

The DSC curve for the first heating is selected from the obtained DSC curve by an analysis program stored in the Q-200 system, to thereby determine a glass transition temperature of the sample with the first heating. Similarly, the DSC curve for the second heating is selected, and the glass transition temperature of the sample with the second heating can be determined.

Moreover, the DSC curve for the first heating is selected from the obtained DSC curve by the analysis program stored in the Q-200 system, and an endothermic peak top temperature of the sample for the first heating is determined as a melting point of the sample. Similarly, the DSC curve for the second heating is selected, and the endothermic peak top temperature of the sample for the second heating can be determined as a melting point of the sample with the second heating.

In the present invention, when a toner is used as a sample, a glass transition temperature for the first heating is represented as Tg1st, and a glass transition temperature for the second heating is represented as Tg2nd.

Moreover, in the present invention, regarding the glass transition temperature and the melting point of the polyester resin, the crystalline polyester resin, and the other constituent components such as the release agent, the endothermic peak top temperature and the Tg in second heating are defined as the melting point and the Tg of each of the target samples, respectively, unless otherwise specified.

<<Measurement Method for Particle Size Distribution>>

The volume average particle diameter (D4), the number average particle diameter (Dn), and the ratio therebetween (D4/Dn) of the toner can be measured using, for example, Coulter Counter TA-II or Coulter Multisizer II (these products are of Coulter, Inc.).

In the present invention, Coulter Multisizer II was used. The measurement method is as follows.

First, a surfactant (0.1 mL to 5 mL), preferably a polyoxyethylene alkyl ether (nonionic surfactant), is added as a dispersing agent to an aqueous electrolyte solution (100 mL to 150 mL). Here, the aqueous electrolyte solution is an about 1% by mass aqueous NaCl solution prepared using 1st grade sodium chloride, and ISOTON-II (product of Coulter, Inc.) can be used as the aqueous electrolyte solution. Next, a measurement sample in an amount of 2 mg to 20 mg is added therein. The resultant aqueous electrolyte solution in which the sample has been suspended is dispersed with an ultrasonic wave disperser for about 1 min to about 3 min. The thus-obtained dispersion liquid is analyzed with the above-described apparatus using an aperture of 100 mm to measure the number or volume of the toner particles (or toner). Then, the volume particle size distribution and the number particle size distribution are calculated from the obtained values.

From these distributions, the volume average particle diameter (D4) and the number average particle diameter (Dn) of the toner can be obtained.

In this measurement, 13 channels are used: 2.00 mm (inclusive) to 2.52 mm (exclusive); 2.52 mm (inclusive) to 3.17 mm (exclusive); 3.17 mm (inclusive) to 4.00 mm (exclusive); 4.00 mm (inclusive) to 5.04 mm (exclusive); 5.04 mm (inclusive) to 6.35 mm (exclusive); 6.35 mm (inclusive) to 8.00 mm (exclusive); 8.00 mm (inclusive) to 10.08 mm (exclusive); 10.08 mm (inclusive) to 12.70 mm (exclusive); 12.70 mm (inclusive) to 16.00 mm (exclusive); 16.00 mm (inclusive) to 20.20 mm (exclusive); 20.20 mm (inclusive) to 25.40 mm (exclusive); 25.40 mm (inclusive) to 32.00 mm (exclusive); and 32.00 mm (inclusive) to 40.30 mm (exclusive); i.e., particles having a particle diameter of 2.00 mm (inclusive) to 40.30 mm (exclusive) were subjected to the measurement.

<<Measurement of Molecular Weight>>

The molecular weight of each of the constituent components of the toner can be measured by the following method, for example.

Gel permeation chromatography (GPC) measuring apparatus: GPC-8220GPC (product of TOSOH CORPORATION)

Column: TSKgel Super HZM-H 15 cm, 3 columns connected (product of TOSOH CORPORATION)

Temperature: 40° C.

Solvent: Tetrahydrofuran (THF)

Flow rate: 0.35 mL/min

Sample: 0.15% by mass sample (0.4 mL) applied

Pretreatment of sample: The toner is dissolved in tetrahydrofuran (THF) (containing a stabilizer, product of Wako Pure Chemical Industries, Ltd.) in a concentration of 0.15% by mass, and the solution is filtrated with a 0.2-mm filter. The resultant filtrate is used as a sample.

This THF sample solution (100 mL) is applied for measurement.

In the measurement of the molecular weight of the sample, the molecular weight distribution of the sample is determined based on the relationship between the logarithmic value and the count number of a calibration curve given by using several monodisperse polystyrene-standard samples.

The standard polystyrene samples used for giving the calibration curve are Showdex STANDARD Std. Nos. S-7300, S-210, S-390, S-875, S-1980, S-10.9, S-629, S-3.0 and S-0.580 (these products are of SHOWA DENKO K.K.).

The detector used is a refractive index (RI) detector.

<Method for Producing Toner>

A method for producing the toner is not particularly limited and may be appropriately selected depending on the intended purpose. The toner is granulated by dispersing an oil phase in an aqueous medium, where the oil phase contains the polyester resin, preferably contains the crystalline polyester resin, and further contains the release agent and the colorant if necessary. In particular, the polyester resin more preferably contains two kinds of polyester resins: the polyester resin having the structure represented by any one of the formulas 1) to 3) and the another polyester resin. Moreover, the toner contains, as the polyester resin, a polyester resin that is the polyester prepolymer (a reaction product of a portion of polyester in R2 and polyisocyanate, i.e., a reaction precursor that is allowed to react with a curing agent), and the another polyester resin that has neither a urethane bond nor a urea bond, and preferably contains the crystalline polyester resin. The toner is more preferably granulated by dispersing an oil phase in an aqueous medium, where the oil phase contains the curing agent, the release agent, and the colorant, if necessary.

One example of such methods for producing the toner is a known dissolution suspension method.

As one example of the methods for producing the toner, a method for forming toner base particles while forming the polyester resin having the structure represented by any one of the formulas 1) to 3) through elongating reaction and/or cross-linking reaction between the polyester prepolymer and the curing agent will be described hereinafter. This method includes preparing an aqueous medium, preparing an oil phase containing toner materials, emulsifying or dispersing the toner materials, and removing an organic solvent.

Preparation of Aqueous Medium (Aqueous Phase)

The preparation of the aqueous phase can be carried out, for example, by dispersing resin particles in an aqueous medium. An amount of the resin particles added to the aqueous medium is not particularly limited and may be appropriately selected depending on the intended purpose, but it is preferably 0.5 parts by mass to 10 parts by mass relative to 100 parts by mass of the aqueous medium.

The aqueous medium is not particularly limited and may be appropriately selected depending on the intended purpose. Examples thereof include water, a solvent miscible with water, and a mixture thereof. These may be used alone or in combination of two or more thereof. Among them, water is preferable.

The solvent miscible with water is not particularly limited and may be appropriately selected depending on the intended purpose. Examples thereof include alcohol, dimethyl formamide, tetrahydrofuran, cellosolve, and lower ketone. The alcohol is not particularly limited and may be appropriately selected depending on the intended purpose. Examples thereof include methanol, isopropanol, and ethylene glycol. The lower ketone is not particularly limited and may be appropriately selected depending on the intended purpose. Examples thereof include acetone and methyl ethyl ketone.

Preparation of Oil Phase

Preparation of the oil phase containing the toner materials can be performed by dissolving or dispersing toner materials in an organic solvent, where the toner materials contain the polyester prepolymer, the another polyester resin, and the crystalline polyester resin, and further contain the curing agent, the release agent, the colorant, if necessary.

The organic solvent is not particularly limited and may be appropriately selected depending on the intended purpose, but it is preferably an organic solvent having a boiling point of less than 150° C., as removal thereof is easy.

The organic solvent having the boiling point of less than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination of two or more thereof.

Among them, ethyl acetate, toluene, xylene, benzene, methylene chloride, 1,2-dichloroethane, chloroform, and carbon tetrachloride are particularly preferable, and ethyl acetate is more preferable.

Emulsification or Dispersion

The emulsification or dispersion of the toner materials can be carried out by dispersing the oil phase containing the toner materials in the aqueous medium. In the course of the emulsification or dispersion of the toner materials, the curing agent and the polyester prepolymer are allowed to carry out a chain-elongation reaction and/or cross-linking reaction, to thereby obtain the polyester resin having the structure represented by any one of the formulas 1) to 3).

The polyester resin having the structure represented by any one of the formulas 1) to 3) may be formed by, for example, any of methods (1) to (3) below.

(1) A method for producing the polyester resin having the structure represented by any one of the formulas 1) to 3), including emulsifying or dispersing an oil phase containing the polyester prepolymer and the curing agent in an aqueous medium, and allowing the curing agent and the polyester prepolymer to undergo elongating reaction and/or cross-linking reaction in the aqueous medium.

(2) A method for producing the polyester resin having the structure represented by any one of the formulas 1) to 3), including emulsifying or dispersing an oil phase containing the polyester prepolymer in an aqueous medium to which the curing agent has been added in advance, and allowing the curing agent and the polyester prepolymer to undergo elongating reaction and/or cross-linking reaction, in the aqueous medium.

(3) A method for producing the polyester resin having the structure represented by any one of the formulas 1) to 3), including emulsifying or dispersing an oil phase containing the polyester prepolymer in an aqueous medium, adding the curing agent to the aqueous medium, and allowing the curing agent and the polyester prepolymer to undergo elongating reaction and/or cross-linking reaction from the interfaces of the particles in the aqueous medium.

Note that, when the curing agent and the polyester prepolymer are allowed to undergo elongating reaction and/or cross-linking reaction from the interfaces of the particles, the polyester resin having the structure represented by any one of the formulas 1) to 3) is formed preferentially in the surfaces of the toner to be formed, and thus concentration gradient of the polyester resin having the structure represented by any one of the formulas 1) to 3) can be provided in the toner.

The reaction conditions (e.g., the reaction time and reaction temperature) for generating the polyester resin having the structure represented by any one of the formulas 1) to 3) are not particularly limited and may be appropriately selected depending on a combination of the curing agent and the polyester prepolymer.

The reaction time is not particularly limited and may be appropriately selected depending on the intended purpose, but it is preferably 10 minutes to 40 hours, more preferably 2 hours to 24 hours.

The reaction temperature is not particularly limited and may be appropriately selected depending on the intended purpose, but it is preferably 0° C. to 150° C., more preferably 40° C. to 98° C.

A method for stably forming a dispersion liquid containing the polyester prepolymer in the aqueous medium is not particularly limited and may be appropriately selected depending on the intended purpose. Examples thereof include a method for dispersing an oil phase, which is added to an aqueous medium, with shear force, where the oil phase is prepared by dissolving or dispersing toner materials in a solvent.

A disperser used for the dispersing is not particularly limited and may be appropriately selected depending on the intended purpose. Examples thereof include a low-speed shearing disperser, a high-speed shearing disperser, a friction disperser, a high-pressure jetting disperser and an ultrasonic wave disperser.

Among them, the high-speed shearing disperser is preferable, because it can control the particle diameters of the dispersed elements (oil droplets) to the range of 2 mm to 20 mm.

In the case where the high-speed shearing disperser is used, the conditions for dispersing, such as the rotating speed, dispersion time, and dispersion temperature, may be appropriately selected depending on the intended purpose.

The rotational speed is not particularly limited and may be appropriately selected depending on the intended purpose, but it is preferably 1,000 rpm to 30,000 rpm, more preferably 5,000 rpm to 20,000 rpm.

The dispersion time is not particularly limited and may be appropriately selected depending on the intended purpose, but it is preferably 0.1 minutes to 5 minutes in case of a batch system.

The dispersion temperature is not particularly limited and may be appropriately selected depending on the intended purpose, but it is preferably 0° C. to 150° C., more preferably 40° C. to 98° C. under pressure. Note that, generally speaking, dispersion can be easily carried out, as the dispersion temperature is higher.

An amount of the aqueous medium used for the emulsification or dispersion of the toner material is not particularly limited and may be appropriately selected depending on the intended purpose, but it is preferably 50 parts by mass to 2,000 parts by mass, more preferably 100 parts by mass to 1,000 parts by mass, relative to 100 parts by mass of the toner material.

When the amount of the aqueous medium is less than 50 parts by mass, the dispersion state of the toner material is impaired, which may result a failure in attaining toner base particles having desired particle diameters. When the amount thereof is more than 2,000 parts by mass, the production cost may increase.

When the oil phase containing the toner material is emulsified or dispersed, a dispersing agent is preferably used for the purpose of stabilizing dispersed elements, such as oil droplets, and gives a shape particle size distribution as well as giving desirable shapes of toner particles.

The dispersing agent is not particularly limited and may be appropriately selected depending on the intended purpose. Examples thereof include a surfactant, a water-insoluble inorganic compound dispersing agent, and a polymer protective colloid. These may be used alone or in combination of two or more thereof. Among them, the surfactant is preferable.

The surfactant is not particularly limited and may be appropriately selected depending on the intended purpose. Examples thereof include an anionic surfactant, a cationic surfactant, a nonionic surfactant, and an amphoteric surfactant.

The anionic surfactant is not particularly limited and may be appropriately selected depending on the intended purpose. Examples thereof include alkyl benzene sulfonic acid salts, a-olefin sulfonic acid salts and phosphoric acid esters. Among them, those having a fluoroalkyl group are preferable.

In cases where the polyester resin having the structure represented by any one of the formulas 1) to 3) is generated, a catalyst can be used for a chain-elongation reaction and/or cross-linking reaction.

The catalyst is not particularly limited and may be appropriately selected depending on the intended purpose. Examples thereof include dibutyltin laurate and dioctyltin laurate.

Removal of Organic Solvent

A method for removing the organic solvent from the dispersion liquid such as the emulsified slurry is not particularly limited and may be appropriately selected depending on the intended purpose. Examples thereof include: a method in which an entire reaction system is gradually heated to evaporate out the organic solvent in the oil droplets; and a method in which the dispersion liquid is sprayed in a dry atmosphere to remove the organic solvent in the oil droplets.

As the organic solvent removed, toner base particles are formed. The toner base particles can be subjected to washing and drying, and can be further subjected to classification. The classification may be carried out in a liquid by removing small particles by cyclone, a decanter, or centrifugal separator, or may be performed on particles after drying.

The obtained toner base particles may be mixed with particles such as the external additive and the charge controlling agent. At this time, by applying a mechanical impact during mixing, the particles such as the external additive can be prevented from fall off from surfaces of toner base particles.

A method for applying the mechanical impact is not particularly limited and may be appropriately selected depending on the intended purpose. Examples thereof include: a method for applying impulse force to a mixture by a blade rotating at high speed; a method for adding a mixture into a high-speed air flow and accelerating the speed of the flow to thereby make the particles crash into other particles, or make the composite particles crush into an appropriate impact board.

A device used for this method is appropriately selected depending on the intended purpose without any limitation, and examples thereof include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

(Developer)

A developer of the present invention contains at least the toner, and may further contain appropriately selected other components, such as carrier, if necessary.

Accordingly, the developer has excellent transfer properties, and charging ability, and can stably form high quality images. Note that, the developer may be a one-component developer, or a two-component developer, but it is preferably a two-component developer when it is used in a high speed printer corresponding to recent high information processing speed, because the service life thereof can be improved.

In the case where the developer is used as a one-component developer, the diameters of the toner particles do not vary largely even when the toner is supplied and consumed repeatedly, the toner does not cause filming to a developing roller, nor fuse to a layer thickness regulating member such as a blade for thinning a thickness of a layer of the toner, and provides excellent and stable developing ability and image even when it is stirred in the developing device over a long period of time.

In the case where the developer is used as a two-component developer, the diameters of the toner particles in the developer do not vary largely even when the toner is supplied and consumed repeatedly, and the toner can provide excellent and stabile developing ability even when the toner is stirred in the developing device over a long period of time.

<Carrier>

The carrier is appropriately selected depending on the intended purpose without any limitation, but it is preferably a carrier containing a core, and a resin layer covering the core.

Core

A material of the core is appropriately selected depending on the intended purpose without any limitation, and examples thereof include a 50 emu/g to 90 emu/g manganese-strontium (Mn—Sr) material, and a 50 emu/g to 90 emu/g manganese-magnesium (Mn—Mg) material. To secure a sufficient image density, use of a hard magnetic material such as iron powder (100 emu/g or more), and magnetite (75 emu/g to 120 emu/g) is preferable. Moreover, use of a soft magnetic material such as a 30 emu/g to 80 emu/g copper-zinc material is preferable because an impact applied to a photoconductor by the developer born on a bearer in the form of a brush can be reduced, which is an advantageous for improving image quality.

These may be used alone or in combination of two or more thereof.

The volume average particle diameter of the core is not particularly limited and may be appropriately selected depending on the intended purpose, but it is preferably 10 mm to 150 mm, more preferably 40 mm to 100 mm. When the volume average particle diameter thereof is less than 10 mm, the proportion of particles in the distribution of carrier particle diameters increases, causing carrier scattering because of low magnetization per carrier particle. When the volume average particle diameter thereof is more than 150 mm, the specific surface area reduces, which may cause toner scattering, causing reproducibility especially in a solid image portion in a full color printing containing many solid image portions.

In the case where the toner is used for a two-component developer, the toner is used by mixing with the carrier. An amount of the carrier in the two-component developer is not particularly limited and may be appropriately selected depending on the intended purpose, but it is preferably 90 parts by mass to 98 parts by mass, more preferably 93 parts by mass to 97 parts by mass, relative to 100 parts by mass of the two-component developer.

A developer of the present invention may be suitably used in image formation by various known electrophotographic methods such as a magnetic one-component developing method, a non-magnetic one-component developing method, and a two-component developing method.

A toner accommodating unit of the present invention accommodates a toner in a unit having a function of accommodating the toner. Here, aspects of the toner accommodating unit are, for example, a toner accommodating container, a developing device, and a process cartridge.

The toner accommodating container is a container accommodating a toner.

The developing device includes a unit accommodating a toner, and configured to perform development.

The process cartridge integrally includes an image bearer and a developing unit, accommodates a toner, and is detachable to an image forming apparatus. The process cartridge may further include at least one selected from the group consisting of a charging unit, an exposing unit, and a cleaning unit.

When the toner accommodating unit of the present invention is mounted on the image forming apparatus to form an image, an image can be formed by using the toner that does not cause filming, and is excellent in low temperature fixing ability, hot offset resistance, high glossiness, high color reproducibility, and heat resistant storage stability.

The developer accommodating container accommodating a developer containing a toner will be described hereinafter.

(Developer Accommodating Container)

A developer accommodating container of the present invention accommodates the developer of the present invention. The container thereof is not particularly limited and may be appropriately selected from known containers. Examples thereof include those having a cap and a container main body.

A size, a shape, a structure and materials of the container main body are not particularly limited. The container main body preferably has, for example, a hollow-cylindrical shape. Particularly preferably, it is a hollow-cylindrical body whose inner surface has spirally-arranged concavo-convex portions some or all of which can accordion and in which the developer accommodated can be transferred to an outlet port through rotation. The materials for the developer-accommodating container are not particularly limited and are preferably those from which the container main body can be formed with high dimensional accuracy. Examples thereof include polyester resins, polyethylene resins, polypropylene resins, polystyrene resins, polyvinyl chloride resins, polyacrylic acids, polycarbonate resins, ABS resins and polyacetal resins.

The above developer accommodating container is excellent in easiness of storage and transportation and handling of the container. Therefore, it can be detachably attached to the below-described process cartridge and image forming apparatus, and can be used for supplying a developer.

(Image Forming Apparatus and Image Forming Method)

An image forming apparatus of the present invention includes at least an electrostatic latent image bearer, an electrostatic latent image forming unit, and a developing unit, and if necessary, further includes other units.

An image forming method of the present invention includes at least an electrostatic latent image forming step and a developing step, and if necessary, further includes other steps.

The image forming method can suitably be performed by the image forming apparatus, the electrostatic latent image forming step can suitably be performed by the electrostatic latent image forming unit, the developing step can suitably be performed by the developing unit, and the other steps can suitably be performed by the other units.

<Electrostatic Latent Image Bearer>

The material, structure and size of the electrostatic latent image bearer are not particularly limited and may be appropriately selected depending on the intended purpose. Examples of the material thereof include inorganic photoconductors such as amorphous silicon and selenium and organic photoconductors such as polysilane and phthalopolymethine. Among them, amorphous silicon is preferable in terms of long lifetime.

The amorphous silicon photoconductor may be, for example, a photoconductor having a support and an electrically photoconductive layer of a-Si, which is formed on the support heated to 50° C. to 400° C. with a film forming method such as vacuum vapor deposition, sputtering, ion plating, thermal CVD (Chemical Vapor Deposition), photo-CVD or plasma CVD. Among them, plasma CVD is suitably employed, in which gaseous raw materials are decomposed through application of direct current or high-frequency or microwave glow discharge to form an a-Si deposition film on the support.

The shape of the electrostatic latent image bearer is not particularly limited and may be appropriately selected depending on the intended purpose, but it is preferably a hollow-cylindrical shape. The outer diameter of the electrostatic latent image bearer having a hollow-cylindrical shape is not particularly limited and may be appropriately selected depending on the intended purpose, but it is preferably 3 mm to 100 mm, more preferably 5 mm to 50 mm, particularly preferably 10 mm to 30 mm.

<Electrostatic Latent Image Forming Unit and Electrostatic Latent Image Forming Step>

The electrostatic latent image forming unit is not particularly limited and may be appropriately selected depending on the intended purpose so long as it is a unit configured to form an electrostatic latent image on the electrostatic latent image bearer. Examples thereof include a unit including at least a charging member configured to charge a surface of the electrostatic latent image bearer and an exposing member configured to imagewise expose the surface of the electrostatic latent image bearer to light.

The electrostatic latent image forming step is not particularly limited and may be appropriately selected depending on the intended purpose so long as it is a step of forming an electrostatic latent image on the electrostatic latent image bearer. The electrostatic latent image forming step can be performed using the electrostatic latent image forming unit by, for example, charging a surface of the electrostatic latent image bearer and then imagewise exposing the surface thereof to light.

Charging Member and Charging

The charging member is not particularly limited and may be appropriately selected depending on the intended purpose. Examples thereof include contact-type charging devices known per se having, for example, an electrically conductive or semiconductive roller, brush, film and rubber blade; and non-contact-type charging devices utilizing corona discharge such as corotron and scorotron.

The charging can be performed by, for example, applying voltage to the surface of the electrostatic latent image bearer by using the charging member.

The charging member may have any shape like a charging roller as well as a magnetic brush or a fur brush. The shape of the charging member may be suitably selected according to the specification or configuration of the image forming apparatus.

The charging member is not limited to the aforementioned contact-type charging members. However, the contact-type charging members are preferably used because an image forming apparatus in which an amount of ozone generated from the charging members is reduced can be obtained Exposing Member and Exposure The exposing member is not particularly limited and may be appropriately selected depending on the purpose so long as it attains desired imagewise exposure on the surface of the electrophotographic latent image bearer charged with the charging member. Examples thereof include various exposing members such as a copy optical exposing device, a rod lens array exposing device, a laser optical exposing device, and a liquid crystal shutter exposing device.

A light source used for the exposing member is not particularly limited and may be appropriately selected depending on the intended purpose. Examples thereof include conventional light-emitting devices such as a fluorescent lamp, a tungsten lamp, a halogen lamp, a mercury lamp, a sodium lamp, a light-emitting diode (LED), a laser diode (LD), and an electroluminescence (EL) device.

Also, various filters may be used for emitting only light having a desired wavelength range. Examples of the filters include a sharp-cut filter, a band-pass filter, an infrared cut filter, a dichroic filter, an interference filter, and a color temperature conversion filter.

The exposure can be performed by, for example, imagewise exposing the surface of the electrostatic latent image bearer to light using the exposing member.

In the present invention, light may be imagewise applied from the side facing the support of the electrostatic latent image bearer.

<Developing Unit and Developing Step>

The developing unit is not particularly limited and may be appropriately selected depending on the intended purpose so long as it is a developing unit containing a toner for developing the electrostatic latent image formed on the electrostatic latent image bearer to thereby form a visible image.

The developing step is not particularly limited and may be appropriately selected depending on the intended purpose so long as it is a step of developing the electrostatic latent image formed on the electrostatic latent image bearer with a toner, to thereby form a visible image. The developing step can be performed by the developing unit.

The developing unit may be a dry or wet developing process, and may be a single-color or multi-color developing unit.

The developing unit is preferably a developing device containing: a stiffing device for charging the toner with friction generated during stirring; a magnetic field-generating unit fixed inside; and a developer bearing member configured to bear a developer containing the toner on a surface thereof and to be rotatable.

In the developing unit, toner particles and carrier particles are stirred and mixed so that the toner particles are charged by friction generated therebetween. The charged toner particles are retained in the chain-like form on the surface of the rotating magnetic roller to form magnetic brushes. The magnetic roller is disposed proximately to the electrostatic latent image developing member and thus, some of the toner particles forming the magnetic brushes on the magnet roller are transferred onto the surface of the electrostatic latent image developing member by the action of electrically attractive force. As a result, the electrostatic latent image is developed with the toner particles to form a visual toner image on the surface of the electrostatic latent image developing member.

<Other Units and Other Steps>

Examples of the other units include a transfer unit, a fixing unit, a cleaning unit, a charge-eliminating unit, a recycling unit, and a controlling unit.

Examples of the other step include a transfer step, a fixing step, a cleaning step, a charge-eliminating step, a recycling step, and a controlling step.

Transfer Unit and Transfer Step

The transfer unit is not particularly limited and may be appropriately selected depending on the intended purpose so long as it is a unit configured to transfer the visible image onto a recording medium. Preferably, the transfer unit includes: a primary transfer unit configured to transfer the visible images to an intermediate transfer member to form a composite transfer image; and a secondary transfer unit configured to transfer the composite transfer image onto a recording medium.

The transfer step is not particularly limited and may be appropriately selected depending on the intended purpose so long as it is a step of transferring the visible image onto a recording medium. In this step, preferably, the visible images are primarily transferred to an intermediate transfer member, and the thus-transferred visible images are secondarily transferred to the recording medium.

For example, the transfer step can be performed using the transfer unit by charging the photoconductor with a transfer charger to transfer the visible image.

Here, when the image to be secondarily transferred onto the recording medium is a color image of several color toners, a configuration can be employed in which the transfer unit sequentially superposes the color toners on top of another on the intermediate transfer member to form an image on the intermediate transfer member, and the image on the intermediate transfer member is secondarily transferred at one time onto the recording medium by the intermediate transfer unit.

The intermediate transfer member is not particularly limited and may be appropriately selected from known transfer members depending on the intended purpose. For example, the intermediate transfer member is preferably a transferring belt.

The transfer unit (including the primary- and secondary transfer units) preferably includes at least a transfer device which transfers the visible images from the photoconductor onto the recording medium. Examples of the transfer device include a corona transfer device employing corona discharge, a transfer belt, a transfer roller, a pressing transfer roller and an adhesive transferring device.

The recording medium is not particularly limited and may be appropriately selected depending on the purpose, so long as it can receive a developed, unfixed image. Examples of the recording medium include plain paper and a PET base for OHP, with plain paper being used typically.

Fixing Unit and Fixing Step

The fixing unit is not particularly limited and may be appropriately selected depending on the intended purpose as long as it is a unit configured to fix a transferred image which has been transferred on the recording medium, but is preferably known heating-pressurizing members. Examples thereof include a combination of a heat roller and a press roller, and a combination of a heat roller, a press roller and an endless belt. The fixing step is not particularly limited and may be appropriately selected depending on the intended purpose, as long as it is a step of fixing a visible image which has been transferred on the recording medium. The fixing step may be performed every time when an image of each color toner is transferred onto the recording medium, or at one time (at the same time) on a laminated image of color toners.

The fixing step can be performed by the fixing unit.

The heating-pressurizing member usually performs heating preferably at 80° C. to 200° C.

Notably, in the present invention, known photofixing devices may be used instead of or in addition to the fixing unit depending on the intended purpose.

A surface pressure at the fixing step is not particularly limited and may be appropriately selected depending on the intended purpose, but is preferably 10 $N/cm^2$ to 80 $N/cm^2$.

Cleaning Unit and Cleaning Step

The cleaning unit is not particularly limited and may be appropriately selected depending on the intended purpose, as long as it can remove the toner remaining on the photoconductor. Examples thereof include a magnetic brush cleaner, an electrostatic brush cleaner, a magnetic roller cleaner, a blade cleaner, a brush cleaner and a web cleaner.

The cleaning step is not particularly limited and may be appropriately selected depending on the intended purpose, as long as it is a step of removing the toner remaining on the photoconductor. It may be performed by the cleaning unit.

Charge-Eliminating Unit and Charge-Eliminating Step

The charge-eliminating unit is not particularly limited and may be appropriately selected depending on the intended purpose, as long as it is a unit configured to apply a charge-eliminating bias to the photoconductor to thereby charge-eliminate. Examples thereof include a charge-eliminating lamp.

The charge-eliminating step is not particularly limited and may be appropriately selected depending on the intended purpose, as long as it is a step of applying a charge-eliminating bias to the photoconductor to thereby charge-eliminate. It may be carried out by the charge-eliminating unit.

Recycling Unit and Recycling Step

The recycling unit is not particularly limited and may be appropriately selected depending on the intended purpose, as long as it is a unit configured to recycle the toner which has been removed at the cleaning step to the developing device. Example thereof includes a known conveying unit.

The recycling step is not particularly limited and may be appropriately selected depending on the intended purpose, as long as it is a step of recycling the toner which has been removed at the cleaning step to the developing device. The recycling step can be performed by the recycling unit.

Control Unit and Control Step

The control unit is not particularly limited and may be appropriately selected depending on the intended purpose, as long as it can control the operation of each of the above units. Examples thereof include devices such as sequencer and computer.

The control step is not particularly limited and may be appropriately selected depending on the intended purpose, as long as it is a step of controlling the operation of each of the above units. The control step can be performed by the control unit.

Next, one aspect of performing a method for forming an image using an image forming apparatus of the present invention will be explained with reference to FIG. 1. A color image forming apparatus 100A illustrated in FIG. 1 includes a photoconductor drum 10 (hereinafter may be referred to as "photoconductor 10") serving as the electrostatic latent image bearer, a charging roller 20 serving as the charging unit, an exposing device 30 serving as the exposing unit, a developing device 40 serving as the developing unit, an intermediate transfer member 50, a cleaning device 60 including a cleaning blade serving as the cleaning blade, and a charge-eliminating lamp 70 serving as the charge-eliminating unit.

The intermediate transfer member 50, which is an endless belt, is stretched around three rollers 51 disposed in the belt, and is designed to be movable in a direction indicated by the arrow. A part of three rollers 51 also functions as a transfer bias roller which can apply a predetermined transfer bias (primary transfer bias) to the intermediate transfer member 50. Near the intermediate transfer member 50, a cleaning device 90 including a cleaning blade is disposed. Also, a transfer roller 80 serving as the transfer unit which can apply a transfer bias onto a transfer paper 95 serving as the recording medium for transferring (secondary transferring) an developed image (toner image) is disposed facing the intermediate transfer member 50. Around the intermediate transfer member 50, a corona charging device 58 for applying a charge to the toner image on the intermediate transfer member 50 is disposed between a contact portion of the photoconductor 10 with the intermediate transfer member 50 and a contact portion of the intermediate transfer member 50 with the transfer paper 95 in a rotational direction of the intermediate transfer member 50.

The developing device 40 is composed of a developing belt 41 serving as the developer bearing member; and a black developing unit 45K, a yellow developing unit 45Y, a magenta developing unit 45M, and a cyan developing unit 45C, which are disposed around the developing belt 41. Note that, the black developing unit 45K includes a developer accommodating unit 42K, a developer supplying roller 43K, and a developing roller 44K. The yellow developing unit 45Y includes a developer accommodating unit 42Y, a developer supplying roller 43Y, and a developing roller 44Y. The magenta developing unit 45M includes a developer accommodating unit 42M, a developer supplying roller 43M, and a developing roller 44M. The cyan developing unit 45C includes a developer accommodating unit 42C, a developer supplying roller 43C, and a developing roller 44C. Moreover, the developing belt 41, which is an endless belt, is stretched so as to be movable around a plurality of belt rollers, and a part of the developing belt 41 contacts with the electrostatic latent image bearer 10.

In the color image forming apparatus 100 illustrated in FIG. 1, for example, the photoconductor drum 10 is uniformly charged by the charging roller 20. Then, the exposing device 30 imagewise exposes the photoconductor drum 10, to thereby form an electrostatic latent image. Next, the electrostatic latent image formed on the photoconductor drum 10 is developed by supplying a developer from the developing device 40, to thereby form a toner image. The toner image is transferred (primarily transferred) onto the intermediate transfer member 50, and is further transferred (secondary transferring) onto the transfer paper 95 by voltage applied from the roller 51. As a result, a transferred image is formed on the transfer paper 95. Note that, a residual toner remaining on the photoconductor 10 is removed by the cleaning device 60, and a charge on the photoconductor 10 is once eliminated by the charge-eliminating lamp 70.

FIG. 2 is another example of an image forming apparatus of the present invention. An image forming apparatus 100B has the same configuration with the image forming apparatus 100A illustrated in FIG. 1, except that the developing belt 41 is not provided, and the black developing unit 45K, the yellow developing unit 45Y, the magenta developing unit 45M, and the cyan developing unit 45C are disposed directly facing the periphery of the photoconductor drum 10.

FIG. 3 illustrates another example of an image forming apparatus of the present invention. The image forming apparatus illustrated in FIG. 3 include a copying device main body 150, a paper feeding table 200, a scanner 300, and an automatic document feeder (ADF) 400.

An intermediate transfer member 50, which is an endless belt type, is disposed at a central part of the copying device main body 150. The intermediate transfer member 50 is stretched around support rollers 14, 15, and 16, and can rotate in a clockwise direction in FIG. 3. Near the support roller 15, an intermediate transfer member cleaning device 17 is disposed in order to remove a residual toner remaining on the intermediate transfer member 50. On the intermediate transfer member 50 stretched around the support roller 14 and the support roller 15, a tandem type developing device 120, in which four image forming units 18 of yellow, cyan, magenta, and black are arranged in parallel so as to face the intermediate transfer member 50 along a conveying direction, is disposed. Near the tandem type developing device 120, an exposing device 21 serving as the exposing member is disposed. A secondary transfer device 22 is disposed on a side of the intermediate transfer member 50 opposite to a side where the tandem type developing device 120 is disposed. In the secondary transfer device 22, a secondary transfer belt 24, which is an endless belt, and is stretched around a pair of rollers 23. The transfer paper conveyed on the secondary transfer belt 24 and the intermediate transfer member 50 can contact each other. Near the secondary transfer device 22, a fixing device 25 serving as the fixing unit is disposed. The fixing device 25 includes a fixing belt 26 which is an endless belt, and a press roller 27 which is disposed so as to be pressed against the fixing belt 26. Here, in the tandem type image forming apparatus, a sheet inverting device 28 configured to invert the transfer paper is disposed near the secondary transfer device 22 and the fixing device 25, in order to form an image on both sides of the transfer paper.

Next, a method for forming a full-color image (color-copying) using the tandem type developing device 120 will be explained. First, a color document is set on a document table 130 of the automatic document feeder (ADF) 400. Alternatively, the automatic document feeder 400 is opened, the color document is set on a contact glass 32 of the scanner 300, and the automatic document feeder 400 is closed.

When a start button (not illustrated) is pressed, the scanner 300 activates after the color document is conveyed and moved to the contact glass 32 in the case the color document has been set on the automatic document feeder 400, or right away in the case the color document has been set on the contact glass 32, so that a first travelling body 33 and a second travelling body 34 travel. At this time, light is irradiated from a light source in the first travelling body 33, the light reflected from a surface of the document is reflected by a mirror in the second travelling body 34 and then is received by a reading sensor 36 through an imaging forming lens 35. Thus, the color document (color image) is read to thereby form black, yellow, magenta and cyan image information.

Each image information of black, yellow, magenta, and cyan is transmitted to each of the image forming units 18 (black image forming unit, yellow image forming unit, magenta image forming unit, and cyan image forming unit) in the tandem type developing device 120, and the toner images of black, yellow, magenta, and cyan are each formed in the image forming units. As illustrated in FIG. 4, the image forming units 18 (black image forming unit, yellow image forming unit, magenta image forming unit, and cyan image forming unit) in the tandem type developing device 120 include: electrostatic latent image bearers 10 (black electrostatic latent image bearer 10K, yellow electrostatic latent image bearer 10Y, magenta electrostatic latent image bearer 10M, and cyan electrostatic latent image bearer 10C); a charging device 160 configured to uniformly charge the electrostatic latent image bearers 10, serving as the charging unit; an exposing device configured to imagewise expose the electrostatic latent image bearers to light (L illustrated in FIG. 4) based on image information for each color, to form an electrostatic latent image corresponding to color images on the electrostatic latent image bearers; a developing device 61 configured to develop the electrostatic latent images with color toners (black toner, yellow toner, magenta toner, and cyan toner) to form a toner image of each of the color toners; a transfer charger 62 configured to transfer the toner image onto the intermediate transfer member 50; a cleaning device 63; and a charge-eliminating unit 64. Each mage forming unit 18 can form a monochrome image (black image, yellow image, magenta image, and cyan image) based on image information of each color. Thus formed black image (i.e., black image formed onto the black electrostatic latent image bearer 10K), yellow image (i.e., yellow image formed onto the yellow electrostatic latent image bearer 10Y), magenta image (i.e., magenta image formed onto the magenta electrostatic latent image bearer 10M), and cyan image (i.e., cyan image formed onto the cyan electrostatic latent image bearer 10C) are sequentially transferred (primarily transferred) onto the intermediate transfer member 50 which is rotatably moved by the support rollers 14, 15 and 16. The black image, the yellow image, the magenta image, and the cyan image are superposed on top of one another on the intermediate transfer member 50 to thereby form a composite color image (color transfer image).

Meanwhile, on the paper feeding table 200, one of paper feeding rollers 142 is selectively rotated to feed a sheet (recording paper) from one of the paper feeding cassettes 144 equipped in multiple stages in a paper bank 143. The sheet is separated one by one by a separation roller 145 and sent to a paper feeding path 146. The sheet (recording paper) is conveyed by a conveying roller 147 and is guided to a paper feeding path 148 in the copying device main body 150, and stops by colliding with a registration roller 49. Alternatively, a paper feeding roller 142 is rotated to feed a sheet (recording paper) on a manual feed tray 54. The sheet (recording paper) is separated one by one by a separation roller 52 and is guided to a manual paper feeding path 53, and stops by colliding with the registration roller 49. Notably, the registration roller 49 is generally used while grounded, but it may also be used in a state that a bias is being applied for removing paper dust on the sheet. Next, by rotating the registration roller 49 in accordance with the timing of the composite toner image (color transferred image) formed on the intermediate transfer member 50, the sheet (recording paper) is fed to between the intermediate transfer member 50 and the secondary transfer device 22. Thereby, the composite toner image (color transferred image) is transferred (secondarily transferred) by the secondary transfer device 22 onto the sheet (recording paper) to thereby form a color image on the sheet (recording paper). Notably, a residual toner remaining on the intermediate transfer member 50 after image transfer is removed by the cleaning device for the intermediate transfer member 17.

The sheet (recording paper) on which the color image has been transferred is conveyed by the secondary transfer device 22, and then conveyed to the fixing device 25. In the fixing device 25, the composite color image (color transferred image) is fixed on the sheet (recording paper) by the action of heat and pressure. Next, the sheet (recording paper) is switched by a switching claw 55, and discharged by a discharge roller 56 and stacked in a paper ejection tray 57. Alternatively, the sheet is switched by the switching claw 55, and is inverted by the inverting device 28 to thereby be guided to a transfer position again. After an image is formed similarly on the rear surface, the recording paper is discharged by the discharge roller 56 stacked in the paper ejection tray 57.

(Process Cartridge)

A process cartridge of the present invention is molded so as to be mounted to various image forming apparatuses in an attachable and detachable manner, including at least an electrostatic latent image bearer configured to bear an electrostatic latent image; and a developing unit configured to form a toner image by developing the electrostatic latent image born on the electrostatic latent image bearer with a developer of the present invention. Note that, the process cartridge of the present invention may further include other units, if necessary.

The developing unit includes a developer accommodating container configured to accommodate the developer of the present invention, and a developer bearing member configured to bear and convey the developer accommodated in the developer accommodating container. Note that, the developing unit further includes a regulating member, and the like, in order to regulate a thickness of the developer born.

FIG. 5 illustrates one example of a process cartridge of the present invention. A process cartridge 110 includes a photoconductor drum 10, a corona charging device 52, a developing device 40, a transfer roller 80, and a cleaning device 90.

EXAMPLES

The present invention will be described by way of Examples below. The present invention may not be construed as being limited to the Examples. Unless otherwise specified, "part(s)" means "part(s) by mass", and "%" means "% by mass".

Each of the measurements in the following Examples was measured based on the methods described herein. Here, a Tg and a molecular weight of the polyester resin having the structure represented by any one of the formulas 1) to 3), the another polyester resin, and the crystalline polyester resin were measured using each of the resins obtained in Production Examples.

Production Example 1

<Synthesis of Ketimine>

A reaction container equipped with a stiffing rod and a thermometer was charged with isophorone diisocyanate (170 parts) and methyl ethyl ketone (75 parts), followed by reaction at 50° C. for 5 hours, to thereby obtain [ketimine compound 1].

The amine value of the obtained [ketimine compound 1] was found to be 418.

Production Example A-1

<Synthesis of Polyester Resin A-1>

Synthesis of Prepolymer A-1

A reaction vessel equipped with a condenser, a stiffing device, and a nitrogen-introducing tube was charged with 3-methyl-1,5-pentanediol, terephthalic acid, and adipic acid so that a ratio by mole of hydroxyl group to carboxyl group "OH/COOH" was 1.2. A diol component was composed of 100 mol % of 3-methyl-1,5-pentanediol, and a dicarboxylic acid component was composed of 50 mol % of terephthalic acid and 50 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 5 hours under a reduced pressure of 10 mmHg to 15 mmHg, to thereby obtain intermediate polyester A'-1.

The obtained intermediate polyester A'-1 was found to have a Tg of −40° C., a Mw of 15,000, and a Mw/Mn of 2.0.

Next, a reaction vessel equipped with a condenser, a stirring device, and a nitrogen-introducing tube was charged with the intermediate polyester A'-1 and lysine triisocyanate (RTI) at a ratio by mole (isocyanate group of RTI/hydroxyl group of the intermediate polyester) of 0.2. The resultant mixture was diluted with ethyl acetate so as to be a 50% ethyl acetate solution, followed by reacting at 100° C. for 5 hours, to thereby obtain intermediate polyester A-1 solution.

The obtained intermediate polyester A-1 was found to have a Tg of −35° C., a Mw of 20,000, and a Mw/Mn of 2.2.

Next, a reaction vessel equipped with a condenser, a stirring device, and a nitrogen-introducing tube was charged with the intermediate polyester A-1 solution and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain prepolymer A-1 solution.

Synthesis of Polyester Resin A-1

The obtained prepolymer A-1 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-1. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-1.

Physical properties of the obtained polyester resin A-1 are given in Table 1-1.

Production Example A-2

<Synthesis of Polyester Resin A-2>

Synthesis of Prepolymer A-2

A reaction vessel equipped with a condenser, a stirring device, and a nitrogen-introducing tube was charged with 3-methyl-1,5-pentanediol, terephthalic acid, and adipic acid so that a ratio by mole of hydroxyl group to carboxyl group "OH/COOH" was 1.2. A diol component was composed of 100 mol % of 3-methyl-1,5-pentanediol, and a dicarboxylic acid component was composed of 50 mol % of terephthalic acid and 50 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 5 hours under a reduced pressure of 10 mmHg to 15 mmHg, to thereby obtain intermediate polyester A'-2.

The obtained intermediate polyester A'-2 was found to have a Tg of −40° C., a Mw of 15,000, and a Mw/Mn of 2.0.

Next, a reaction vessel equipped with a condenser, a stirring device, and a nitrogen-introducing tube was charged with the intermediate polyester A'-2 and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain intermediate polyester A-2 solution.

Then, a reaction vessel equipped with a condenser, a stirring device, and a nitrogen-introducing tube was charged with the intermediate polyester A-2 solution and trimethylolpropane (TMP) at a ratio by mole (the isocyanate group of the intermediate polyester A-2/the hydroxyl group of TMP) of 5.0. The resultant mixture was diluted with ethyl acetate so as to be a 50% ethyl acetate solution, followed by reacting at 100° C. for 5 hours, to thereby obtain prepolymer A-2.

Synthesis of Polyester Resin A-2

The obtained prepolymer A-2 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-2. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-2.

Physical properties of the obtained polyester resin A-2 are given in Table 1-1.

Production Example A-3

<Synthesis of Polyester Resin A-3>

Synthesis of Prepolymer A-3

A reaction vessel equipped with a condenser, a stirring device, and a nitrogen-introducing tube was charged with 3-methyl-1,5-pentanediol, terephthalic acid, and adipic acid so that a ratio by mole of hydroxyl group to carboxyl group "OH/COOH" was 1.2. A diol component was composed of 100 mol % of 3-methyl-1,5-pentanediol, and a dicarboxylic acid component was composed of 50 mol % of terephthalic acid and 50 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 5 hours under a reduced pressure of 10 mmHg to 15 mmHg, to thereby obtain intermediate polyester A'-3.

The obtained intermediate polyester A'-3 was found to have a Tg of −40° C., a Mw of 15,000, and a Mw/Mn of 2.0.

Next, a reaction vessel equipped with a condenser, a stirring device, and a nitrogen-introducing tube was charged with the intermediate polyester A'-3 and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain intermediate polyester A'-3 solution.

The obtained intermediate polyester A-3 was found to have a Tg of −35° C., a Mw of 20,000, and a Mw/Mn of 2.2.

Next, a reaction vessel equipped with a condenser, a stiffing device, and a nitrogen-introducing tube was charged with the intermediate polyester A-3 and lysine triisocyanate (RTI) at a ratio by mole (isocyanate group of RTI/hydroxyl group of the intermediate polyester) of 0.2. The resultant mixture was diluted with ethyl acetate so as to be a 50% ethyl acetate solution, and pure water was added dropwise to the mixture in such an amount that a ratio by mole of an amount of NCO remaining in the reaction system was 0.5. The resultant mixture was allowed to react at 100° C. for 5 hours, to thereby obtain prepolymer A-3 solution.

Synthesis of Polyester Resin A-3

The obtained prepolymer A-3 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-3. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-3.

Physical properties of the obtained polyester resin A-3 are given in Table 1-1.

Production Example A-4

<Synthesis of Polyester Resin A-4>

Synthesis of Prepolymer A-4

A reaction vessel equipped with a condenser, a stiffing device, and a nitrogen-introducing tube was charged with hexanediol, terephthalic acid, and adipic acid so that a ratio by mole of hydroxyl group to carboxyl group "OH/COOH" was 1.2. A diol component was composed of 100 mol % of hexanediol, and a dicarboxylic acid component was 30 mol % of terephthalic acid and 70 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the mixture was allowed to further react for 5 hours under a reduced pressure of 10 mmHg to 15 mmHg, to thereby obtain intermediate polyester A'-4.

The obtained intermediate polyester A'-4 was found to have a Tg of −30° C., a Mw of 12,000, and a Mw/Mn of 2.1.

Next, a reaction vessel equipped with a condenser, a stiffing device, and a nitrogen-introducing tube was charged with the intermediate polyester A'-4 and lysine triisocyanate (RTI) at a ratio by mole (isocyanate group of RTI/hydroxyl group of the intermediate polyester) of 0.2. The resultant mixture was diluted with ethyl acetate so as to be a 50% ethyl acetate solution, followed by reacting at 100° C. for 5 hours, to thereby obtain intermediate polyester A-4 solution.

The obtained intermediate polyester A-4 was found to have a Tg of −25° C., a Mw of 18,000, and a Mw/Mn of 2.3.

A reaction vessel equipped with a condenser, a stirring device, and a nitrogen-introducing tube was charged with the intermediate polyester A-4 solution and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain prepolymer A-4 solution.

Synthesis of Polyester Resin A-4

The obtained prepolymer A-4 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-4. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-4.

Physical properties of the obtained polyester resin A-4 are given in Table 1-1.

Production Example A-5

<Synthesis of Polyester Resin A-5>

Synthesis of Prepolymer A-5

A reaction vessel equipped with a condenser, a stiffing device, and a nitrogen-introducing tube was charged with 3-methyl-1,5-pentanediol, terephthalic acid, and adipic acid so that a ratio by mole of hydroxyl group to carboxyl group "OH/COOH" was 1.2. A diol component was composed of 100 mol % of 3-methyl-1,5-pentanediol, and a dicarboxylic acid component was composed of 10 mol % of terephthalic acid and 90 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 5 hours under a reduced pressure of 10 mmHg to 15 mmHg, to thereby obtain intermediate polyester A'-5.

The obtained intermediate polyester A'-5 was found to have a Tg of −70° C., a Mw of 13,000, and a Mw/Mn of 2.2.

Next, a reaction vessel equipped with a condenser, a stiffing device, and a nitrogen-introducing tube was charged with the intermediate polyester A'-5 and lysine triisocyanate (RTI) at a ratio by mole (isocyanate group of RTI/hydroxyl group of the intermediate polyester) of 0.2. The resultant mixture was diluted with ethyl acetate so as to be a 50% ethyl acetate solution, followed by reacting at 100° C. for 5 hours, to thereby obtain intermediate polyester A-5 solution. The obtained intermediate polyester A-5 was found to have a Tg of −65° C., a Mw of 19,000, and a Mw/Mn of 2.4.

A reaction vessel equipped with a condenser, a stirring device, and a nitrogen-introducing tube was charged with the intermediate polyester A-5 solution and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain prepolymer A-5 solution.

Synthesis of Polyester Resin A-5

The obtained prepolymer A-5 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-5. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-5.

Physical properties of the obtained polyester resin A-5 are given in Table 1-1.

Production Example A-6

<Synthesis of Polyester Resin A-6>

Synthesis of Prepolymer A-6

A reaction vessel equipped with a condenser, a stiffing device, and a nitrogen-introducing tube was charged with 3-methyl-1,5-pentanediol, terephthalic acid, and adipic acid so that a ratio by mole of hydroxyl group to carboxyl group "OH/COOH" was 1.2. A diol component was composed of 100 mol % of 3-methyl-1,5-pentanediol, and a dicarboxylic acid component was composed of 90 mol % of terephthalic acid and 10 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 5 hours under a reduced pressure of 10 mmHg to 15 mmHg, to thereby obtain intermediate polyester A'-6.

The obtained intermediate polyester A'-6 was found to have a Tg of −5° C., a Mw of 13,000, and a Mw/Mn of 2.2.

Next, a reaction vessel equipped with a condenser, a stiffing device, and a nitrogen-introducing tube was charged with the intermediate polyester A'-6 and lysine triisocyanate (RTI) at a ratio by mole (isocyanate group of RTI/hydroxyl group of the intermediate polyester) of 0.2. The resultant mixture was diluted with ethyl acetate so as to be a 50% ethyl acetate solution, followed by reacting at 100° C. for 5 hours, to thereby obtain intermediate polyester A-6 solution. The obtained intermediate polyester A-6 was found to have a Tg of 0° C., a Mw of 19,000, and a Mw/Mn of 2.4.

A reaction vessel equipped with a condenser, a stirring device, and a nitrogen-introducing tube was charged with the intermediate polyester A-6 solution and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain prepolymer A-6 solution.

Synthesis of Polyester Resin A-6

The obtained prepolymer A-6 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-6. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-6.

Physical properties of the obtained polyester resin A-6 are given in Table 1-2.

Production Example A-7

<Synthesis of Polyester Resin A-7>

Synthesis of Prepolymer A-7

A reaction vessel equipped with a condenser, a stirring device, and a nitrogen-introducing tube was charged with 3-methyl-1,5-pentanediol, terephthalic acid, adipic acid, and trimethylolpropane so that a ratio by mole of hydroxyl group to carboxyl group "OH/COOH" was 1.5. A diol component was composed of 100 mol % of 3-methyl-1,5-pentanediol, and a dicarboxylic acid component was composed of 60 mol % of terephthalic acid and 40 mol % of adipic acid. An amount of trimethylolpropane was 1% by mole relative to the total amount of the monomers. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the mixture was allowed to further react for 5 hours under a reduced pressure of 10 mmHg to 15 mmHg, to thereby obtain intermediate polyester A-7. The obtained intermediate polyester A-7 was found to have a Tg of −30° C., a Mw of 10,000, and a Mw/Mn of 2.5.

Next, a reaction vessel equipped with a condenser, a stiffing device, and a nitrogen-introducing tube was charged with the intermediate polyester A-7 and isophorone diisocyanate (IPDI) at a ratio by mole (isocyanate group of IPDI/hydroxyl group of the intermediate polyester) of 1.8. The resultant mixture was diluted with ethyl acetate so as to be a 50% ethyl acetate solution, followed by reacting at 100° C. for 5 hours, to thereby obtain intermediate polyester A-7.

Synthesis of Polyester Resin A-7

The obtained prepolymer A-7 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-7. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-7.

Physical properties of the obtained polyester resin A-7 are given in Table 2.

Production Example A-8

<Synthesis of Polyester Resin A-8>

Synthesis of Prepolymer A-8

A reaction vessel equipped with a condenser, a stirring device, and a nitrogen-introducing tube was charged with 3-methyl-1,5-pentanediol, terephthalic acid, and adipic acid so that a ratio by mole of hydroxyl group to carboxyl group "OH/COOH" was 1.2. A diol component was composed of 100 mol % of 3-methyl-1,5-pentanediol, and a dicarboxylic acid component was composed of 50 mol % of terephthalic acid and 50 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 5 hours under a reduced pressure of 10 mmHg to 15 mmHg, to thereby obtain intermediate polyester A'-8.

The obtained intermediate polyester A'-8 was found to have a Tg of −40° C., a Mw of 15,000, and a Mw/Mn of 2.0.

Next, a reaction vessel equipped with a condenser, a stiffing device, and a nitrogen-introducing tube was charged with the intermediate polyester A'-8 and isophorone diisocyanate (IPDI) at a ratio by mole (isocyanate group of IPDI/hydroxyl group of the intermediate polyester) of 0.2. The resultant mixture was diluted with ethyl acetate so as to be a 50% ethyl acetate solution, followed by reacting at 100° C. for 5 hours, to thereby obtain intermediate polyester A-8 solution.

The obtained intermediate polyester A-8 was found to have a Tg of −34° C., a Mw of 17,000, and a Mw/Mn of 2.2.

A reaction vessel equipped with a condenser, a stirring device, and a nitrogen-introducing tube was charged with the intermediate polyester A-8 solution and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain prepolymer A-8 solution.

Synthesis of Polyester Resin A-8

The obtained prepolymer A-8 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-8. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-8.

Physical properties of the obtained polyester resin A-8 are given in Table 2.

Production Example A-9

<Synthesis of Polyester Resin A-9>

Synthesis of Prepolymer A-9

A reaction vessel equipped with a condenser, a stiffing device, and a nitrogen-introducing tube was charged with 3-methyl-1,5-pentanediol, isophthalic acid, adipic acid, and trimellitic anhydride so that a ratio by mole of hydroxyl group to carboxyl group "OH/COOH" was 1.5. A diol component was composed of 100 mol % of 3-methyl-1,5-pentanediol, and a dicarboxylic acid component was composed of 40 mol % of isophthalic acid and 60 mol % of adipic acid. An amount of trimellitic anhydride was 1 mol %, relative to the total amount of the monomers. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 5 hours under a reduced pressure of 10 mmHg to 15 mmHg, to thereby obtain intermediate polyester A-9.

The obtained intermediate polyester A-9 was found to have a Tg of −50° C., a Mw of 18,000, and a Mw/Mn of 2.4.

Next, a reaction vessel equipped with a condenser, a stirring device, and a nitrogen-introducing tube was charged with the intermediate polyester A-9 and isophorone diisocyanate (IPDI) at a ratio by mole (isocyanate group of IPDI/hydroxyl group of the intermediate polyester) of 2.0. The resultant mixture was diluted with ethyl acetate so as to be a 50% ethyl acetate solution, followed by reacting at 100° C. for 5 hours, to thereby obtain prepolymer A-9.

Synthesis of Polyester Resin A-9

The obtained prepolymer A-9 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-9. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-9.

Physical properties of the obtained polyester resin A-9 are given in Table 2.

Production Example A-10

<Synthesis of Polyester Resin A-10>

Synthesis of Prepolymer A-10

A reaction vessel equipped with a condenser, a stiffing device, and a nitrogen-introducing tube was charged with 3-methyl-1,5-pentanediol, terephthalic acid, and adipic acid so that a ratio by mole of hydroxyl group to carboxyl group "OH/COOH" was 1.15. A diol component was composed of 100 mol % of 3-methyl-1,5-pentanediol, and a dicarboxylic acid component was composed of 40 mol % of terephthalic acid and 60 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 6 hours under a reduced pressure of 10 mmHg to 15 mmHg, to thereby obtain intermediate polyester A'-10. The obtained intermediate polyester A'-10 was found to have a Tg of −50° C., a Mw of 18,000, and a Mw/Mn of 2.0.

Next, a reaction vessel equipped with a condenser, a stirring device, and a nitrogen-introducing tube was charged with the intermediate polyester A'-1 and isocyanurate-type triisocyanate introduced from hexamethylene diisocyanate (BURNOCK DN-901S, product of DIC CORPORATION) at a ratio by mole (isocyanate group of DN-901S/hydroxyl group of the intermediate polyester) of 0.1. The resultant mixture was diluted with ethyl acetate so as to be a 50% ethyl acetate solution, followed by reacting at 100° C. for 5 hours, to thereby obtain intermediate polyester A-10 solution.

The obtained intermediate polyester A-10 was found to have a Tg of −45° C., a Mw of 22,000, and a Mw/Mn of 2.2.

Next, a reaction vessel equipped with a condenser, a stirring device, and a nitrogen-introducing tube was charged with the intermediate polyester A-10 solution and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain prepolymer A-10 solution.

Synthesis of Polyester Resin A-10

The obtained prepolymer A-10 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-10. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-10.

Physical properties of the obtained polyester resin A-10 are given in Table 1-2.

Production Example A-11

<Synthesis of Polyester Resin A-11

Synthesis of Prepolymer A-11

A reaction vessel equipped with a condenser, a stiffing device, and a nitrogen-introducing tube was charged with 3-methyl-1,5-pentanediol, terephthalic acid, and adipic acid so that a ratio by mole of hydroxyl group to carboxyl group "OH/COOH" was 1.2. A diol component was composed of 100 mol % of 3-methyl-1,5-pentanediol, and a dicarboxylic acid component was composed of 15 mol % of terephthalic acid and 85 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 5 hours under a reduced pressure of 10 mmHg to 15 mmHg, to thereby obtain intermediate polyester A'-11.

The obtained intermediate polyester A'-11 was found to have a Tg of −65° C., a Mw of 14,000, and a Mw/Mn of 2.0.

Next, a reaction vessel equipped with a condenser, a stirring device, and a nitrogen-introducing tube was charged with the intermediate polyester A'-11 and lysine triisocyanate (RTI) at a ratio by mole (isocyanate group of RTI/hydroxyl group of the intermediate polyester) of 0.2. The resultant mixture was diluted with ethyl acetate so as to be a 50% ethyl acetate solution, followed by reacting at 100° C. for 5 hours, to thereby obtain intermediate polyester A-11 solution.

The obtained intermediate polyester A-11 was found to have a Tg of −60° C., a Mw of 20,000, and a Mw/Mn of 2.3.

Next, a reaction vessel equipped with a condenser, a stirring device, and a nitrogen-introducing tube was charged with the intermediate polyester A-11 solution and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain prepolymer A-11 solution.

Synthesis of Polyester Resin A-11

The obtained prepolymer A-11 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-11. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-11.

Physical properties of the obtained polyester resin A-11 are given in Table 1-2.

Production Example A-12

<Synthesis of Polyester Resin A-12>

Synthesis of Prepolymer A-12

A reaction vessel equipped with a condenser, a stirring device, and a nitrogen-introducing tube was charged with 3-methyl-1,5-pentanediol, terephthalic acid, and adipic acid so that a ratio by mole of hydroxyl group to carboxyl group "OH/COOH" was 1.2. A diol component was composed of 100 mol % of 3-methyl-1,5-pentanediol, and a dicarboxylic acid component was composed of 85 mol % of terephthalic acid and 15 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 5 hours under a reduced pressure of 10 mmHg to 15 mmHg, to thereby obtain intermediate polyester A'-12.

The obtained intermediate polyester A'-12 was found to have a Tg of −5° C., a Mw of 12,000, and a Mw/Mn of 2.1.

Next, a reaction vessel equipped with a condenser, a stirring device, and a nitrogen-introducing tube was charged with the intermediate polyester A'-12 and lysine triisocyanate (RTI) at a ratio by mole (isocyanate group of RTI/hydroxyl group of the intermediate polyester) of 0.2. The resultant mixture was diluted with ethyl acetate so as to be a 50% ethyl acetate solution, followed by reacting at 100° C. for 5 hours, to thereby obtain intermediate polyester A-12 solution.

The obtained intermediate polyester A-12 was found to have a Tg of 0° C., a Mw of 18,000, and a Mw/Mn of 2.3.

Next, a reaction vessel equipped with a condenser, a stirring device, and a nitrogen-introducing tube was charged with the intermediate polyester A-12 solution and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain prepolymer A-12 solution.

Synthesis of Polyester Resin A-12

The obtained prepolymer A-12 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-12. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-12.

Physical properties of the obtained polyester resin A-12 are given in Table 1-2.

Production Example A-13

<Synthesis of Polyester Resin A-13>

Synthesis of Prepolymer A-13

A reaction vessel equipped with a condenser, a stirring device, and a nitrogen-introducing tube was charged with 3-methyl-1,5-pentanediol, terephthalic acid, and adipic acid so that a ratio by mole of hydroxyl group to carboxyl group "OH/COOH" was 1.2. A diol component was composed of 100 mol % of 3-methyl-1,5-pentanediol, and a dicarboxylic acid component was composed of 50 mol % of terephthalic acid and 50 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 5 hours under a reduced pressure of 10 mmHg to 15 mmHg, to thereby obtain intermediate polyester A'-13.

The obtained intermediate polyester A'-13 was found to have a Tg of −40° C., a Mw of 15,000, and a Mw/Mn of 2.0.

Next, a reaction vessel equipped with a condenser, a stirring device, and a nitrogen-introducing tube was charged with the intermediate polyester A'-13 and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain intermediate polyester A-13 solution.

Next, a reaction vessel equipped with a condenser, a stiffing device, and a nitrogen-introducing tube was charged with the intermediate polyester A-13 solution and 1,2,3,4-butanetetaol (BT) at a ratio by mole (isocyanate group of intermediate polyester A-13/hydroxyl group of BT) of 5.0. The resultant mixture was diluted with ethyl acetate so as to be a 50% ethyl acetate solution, followed by reacting at 100° C. for 5 hours, to thereby obtain prepolymer A-13 solution.

Synthesis of Polyester Resin A-13

The obtained prepolymer A-13 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-13. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-13.

Physical properties of the obtained polyester resin A-13 are given in Table 1-2.

Production Example A-14

<Synthesis of Polyester Resin A-14>

Synthesis of Prepolymer A-14

A reaction vessel equipped with a condenser, a stiffing device, and a nitrogen-introducing tube was charged with 2-methyl-1,4-butanediol, terephthalic acid, and adipic acid so that a ratio by mole of hydroxyl group to carboxyl group "OH/COOH" was 1.2. A diol component was composed of 100 mol % of 2-methyl-1,4-butanediol, and a dicarboxylic acid component was composed of 30 mol % of terephthalic acid and 70 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 5 hours under a reduced pressure of 10 mmHg to 15 mmHg, to thereby obtain intermediate polyester A'-14.

The obtained intermediate polyester A'-14 was found to have a Tg of −32° C., a Mw of 13,000, and a Mw/Mn of 2.1.

Next, a reaction vessel equipped with a condenser, a stirring device, and a nitrogen-introducing tube was charged with the intermediate polyester A'-14 and lysine triisocyanate (RTI) at a ratio by mole (isocyanate group of RTI/hydroxyl group of the intermediate polyester) of 0.2. The resultant mixture was diluted with ethyl acetate so as to be a 50% ethyl acetate solution, followed by reacting at 100° C. for 5 hours, to thereby obtain intermediate polyester A-14 solution.

The obtained intermediate polyester A-14 was found to have a Tg of −27° C., a Mw of 19,000, and a Mw/Mn of 2.3.

Next, a reaction vessel equipped with a condenser, a stiffing device, and a nitrogen-introducing tube was charged with the intermediate polyester A-14 solution and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain prepolymer A-14 solution.

Synthesis of Polyester Resin A-14

The obtained prepolymer A-14 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-14. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-14.

Physical properties of the obtained polyester resin A-14 are given in Table 1-3.

Production Example A-15

<Synthesis of Polyester Resin A-15>

Synthesis of Prepolymer A-15

A reaction vessel equipped with a condenser, a stiffing device, and a nitrogen-introducing tube was charged with 1,5-pentanediol, terephthalic acid, and adipic acid so that a ratio by mole of hydroxyl group to carboxyl group "OH/COOH" was 1.2. A diol component was composed of 100 mol % of 1,5-pentanediol, and a dicarboxylic acid component was composed of 60 mol % of terephthalic acid and 40 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 5 hours under a reduced pressure of 10 mmHg to 15 mmHg, to thereby obtain intermediate polyester A'-15.

The obtained intermediate polyester A'-15 was found to have a Tg of −38° C., a Mw of 12,000, and a Mw/Mn of 2.1.

Next, a reaction vessel equipped with a condenser, a stiffing device, and a nitrogen-introducing tube was charged with the intermediate polyester A'-15 and lysine triisocyanate (RTI) at a ratio by mole (isocyanate group of RTI/hydroxyl group of the intermediate polyester) of 0.2. The resultant mixture was diluted with ethyl acetate so as to be a 50% ethyl acetate solution, followed by reacting at 100° C. for 5 hours, to thereby obtain intermediate polyester A-15 solution.

The obtained intermediate polyester A-15 was found to have a Tg of −28° C., a Mw of 18,000, and a Mw/Mn of 2.3.

Next, a reaction vessel equipped with a condenser, a stiffing device, and a nitrogen-introducing tube was charged with the intermediate polyester A-15 solution and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain prepolymer A-15 solution.

Synthesis of Polyester Resin A-15

The obtained prepolymer A-15 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-15. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-15.

Physical properties of the obtained polyester resin A-15 are given in Table 1-3.

Production Example A-16

<Synthesis of Polyester Resin A-16>

Synthesis of Prepolymer A-16

A reaction vessel equipped with a condenser, a stiffing device, and a nitrogen-introducing tube was charged with 3-methyl-1,5-pentanediol, terephthalic acid, and adipic acid so that a ratio by mole of hydroxyl group to carboxyl group "OH/COOH" was 1.1. A diol component was composed of 100 mol % of 3-methyl-1,5-pentanediol, and a dicarboxylic acid component was composed of 60 mol % of terephthalic acid and 40 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 5 hours under a reduced pressure of 10 mmHg to 15 mmHg, to thereby obtain intermediate polyester A'-16.

The obtained intermediate polyester A'-16 was found to have a Tg of −30° C., a Mw of 20,000, and a Mw/Mn of 2.4.

Next, a reaction vessel equipped with a condenser, a stiffing device, and a nitrogen-introducing tube was charged with the intermediate polyester A'-16 and lysine triisocyanate (RTI) at a ratio by mole (isocyanate group of RTI/hydroxyl group of the intermediate polyester) of 0.6. The resultant mixture was diluted with ethyl acetate so as to be a 50% ethyl acetate solution, followed by reacting at 100° C. for 5 hours, to thereby obtain intermediate polyester A-16 solution.

The obtained intermediate polyester A-16 was found to have a Tg of −20° C., a Mw of 35,000, and a Mw/Mn of 2.4.

Physical properties of the obtained polyester resin A-16 are given in Table 1-3.

Production Example A-17

<Synthesis of Polyester Resin A-17>

Synthesis of Prepolymer A-17

A reaction vessel equipped with a condenser, a stiffing device, and a nitrogen-introducing tube was charged with 3-methyl-1,5-pentanediol, terephthalic acid, and adipic acid so that a ratio by mole of hydroxyl group to carboxyl group "OH/COOH" was 1.18. A diol component was composed of 100 mol % of 3-methyl-1,5-pentanediol, and a dicarboxylic acid component was composed of 40 mol % of terephthalic acid and 60 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 6 hours under a reduced pressure of 10 mmHg to 15 mmHg, to thereby obtain intermediate polyester A'-17.

The obtained intermediate polyester A'-17 was found to have a Tg of −53° C., a Mw of 15,000, and a Mw/Mn of 2.0.

Next, a reaction vessel equipped with a condenser, a stirring device, and a nitrogen-introducing tube was charged with the intermediate polyester A'-17 and isocyanurate-type triisocyanate introduced from hexamethylene diisocyanate (BURNOCK DN-901S, product of DIC CORPORATION) at a ratio by mole (isocyanate group of DN-901S/hydroxyl group of the intermediate polyester) of 0.4. The resultant mixture was diluted with ethyl acetate so as to be a 50% ethyl acetate solution, followed by reacting at 100° C. for 5 hours, to thereby obtain intermediate polyester A-17 solution. The obtained intermediate polyester A-17 was found to have a Tg of −43° C., a Mw of 24,000, and a Mw/Mn of 2.4. Next, a reaction vessel equipped with a condenser, a stiffing device, and a nitrogen-introducing tube was charged with the intermediate polyester A-17 solution and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain prepolymer A-17 solution.

Synthesis of Polyester Resin A-17

The obtained prepolymer A-17 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-17. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-17.

Physical properties of the obtained polyester resin A-17 are given in Table 1-3.

Production Example A-18

<Synthesis of Polyester Resin A-18>

Synthesis of Prepolymer A-18

A reaction vessel equipped with a condenser, a stiffing device, and a nitrogen-introducing tube was charged with 3-methyl-1,5-pentanediol, terephthalic acid, and adipic acid so that a ratio by mole of hydroxyl group to carboxyl group "OH/COOH" was 1.18. A diol component was composed of 100 mol % of 3-methyl-1,5-pentanediol, and a dicarboxylic acid component was composed of 40 mol % of terephthalic acid and 60 mol % of adipic acid. Moreover, titanium tetraisopropoxide (1,000 ppm relative to the resin component) was added thereto.

Thereafter, the resultant mixture was heated to 200° C. for about 4 hours, then was heated to 230° C. for 2 hours, and was allowed to react until no flowing water was formed.

Thereafter, the reaction mixture was allowed to further react for 6 hours under a reduced pressure of 10 mmHg to 15 mmHg, to thereby obtain intermediate polyester A'-18. The obtained intermediate polyester A'-18 was found to have a Tg of −53° C., a Mw of 15,000, and a Mw/Mn of 2.0. Next, a reaction vessel equipped with a condenser, a stiffing device, and a nitrogen-introducing tube was charged with the intermediate polyester A'-18 and isocyanurate-type triisocyanate introduced from hexamethylene diisocyanate (BURNOCK DN-901S, product of DIC CORPORATION) at a ratio by mole (isocyanate group of DN-901S/hydroxyl group of the intermediate polyester) of 0.8. The resultant mixture was diluted with ethyl acetate so as to be a 50% ethyl acetate solution, followed by reacting at 100° C. for 5 hours, to thereby obtain intermediate polyester A-18 solution. The obtained intermediate polyester A-18 was found to have a Tg of −40° C., a Mw of 28,000, and a Mw/Mn of 2.6. Next, a reaction vessel equipped with a condenser, a stiffing device, and a nitrogen-introducing tube was charged with the intermediate polyester A-18 solution and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hours, to thereby obtain prepolymer A-18 solution.

Synthesis of Polyester Resin A-18

The obtained prepolymer A-18 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer A-18. The reaction mixture was stirred at 45° C. for 10 hours, and then a preprepolymer product extended was taken out.

The obtained preprepolymer product extended was dried at 50° C. under a reduced pressure until an amount of the remaining ethyl acetate was 100 ppm or less, to thereby obtain non-crystalline polyester resin A-18.

Physical properties of the obtained polyester resin A-18 are given in Table 1-3.

Production Example B-1

<Synthesis of Polyester Resin B-1>

A four-necked flask equipped with a nitrogen-introducing tube, a dehydration tube, a stiffing device, and a thermocouple was charged with bisphenol A ethylene oxide 2 mole adduct, bisphenol A propylene oxide 3 mole adduct, isophthalic acid, and adipic acid so that a ratio by mole of bisphenol A ethylene oxide 2 mole adduct to bisphenol A propylene oxide 3 mole adduct (bisphenol A ethylene oxide 2 mole adduct/bisphenol A propylene oxide 3 mole adduct) was set to 85/15, a ratio by mole of terephthalic acid to adipic acid (terephthalic acid/adipic acid) was set to 80/20, and a ratio by mole of hydroxyl group to carboxyl group "OH/COOH" was 1.2. Moreover, titanium tetraisopropoxide (500 ppm relative to the resin component) was added thereto and the resultant mixture was allowed to react under normal pressure at 230° C. for 8 hours and then to further react under a reduced pressure of 10 mmHg to 15 mmHg for 4 hours. Then, trimellitic anhydride was added to the vessel so that an amount thereof was 1 mol % relative to the total resin component, followed by reacting at 180° C. under normal pressure for 3 hours, to thereby obtain non-crystalline polyester resin B-1. Physical properties of the obtained non-crystalline polyester resin B-1 are given in Tables 1-1, 1-2, and 2.

Production Example C-1

<Synthesis of Crystalline Polyester Resin C-1>

A four-necked flask of 5 L equipped with a nitrogen-introducing tube, a dehydration tube, a stirring device, and a thermocouple was charged with dodecanedioic acid and 1,6-hexanediol so that a ratio by mole of hydroxyl group to carboxyl group "OH/COOH" was 0.9. Moreover, titanium tetraisopropoxide (500 ppm relative to the resin component) was added thereto, and the resultant mixture was allowed to react at 180° C. for 10 hours, heated to 200° C., allowed to react 3 hours, and then to further react under a pressure of 8.3 kPa for 2 hours to thereby obtain crystalline polyester resin C-1.

Physical properties of the obtained crystalline polyester resin C-1 are given in Tables 1-1, 1-2, and 2.

Example 1

<Synthesis of Master Batch (MB)>

Water (1,200 parts), 500 parts of carbon black (PRINTEX 35, product of Degussa) [DBP oil absorption amount=42 mL/100 mg, pH=9.5], and 500 parts of the polyester resin B-1 were added and mixed together by HENSCHEL MIXER (product of Mitsui Mining Co., Ltd.), and the resultant mixture was kneaded by a two roll mill for 30 minutes at 150° C. The kneaded product was rolled out and cooled, followed by pulverizing by a pulverizer, to thereby obtain [master batch 1].

<Preparation of WAX Dispersion Liquid>

A vessel to which a stirring bar and a thermometer had been set was charged with 50 parts of paraffin wax (HNP-9, product of Nippon Seiro Co., Ltd., hydrocarbon wax, melting point: 75° C., SP value: 8.8) as release agent 1, and 450 parts of ethyl acetate, followed by heating to 80° C. during stirring. The temperature was maintained at 80° C. for 5 hours, and then the mixture was cooled to 30° C. for 1 hour. The resultant mixture was dispersed by a bead mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 3 passes, to thereby obtain [WAX dispersion liquid 1].

<Preparation of Crystalline Polyester Resin Dispersion Liquid>

A vessel to which a stirring bar and a thermometer had been set was charged with 50 parts of the crystalline polyester resin C-1, 450 parts of ethyl acetate, followed by heating to 80° C. during stirring. The temperature was maintained at 80° C. for 5 hours, followed by cooling to 30° C. for 1 hour. The resultant mixture was dispersed by a bead mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 3 passes, to thereby obtain [crystalline polyester resin dispersion liquid 1].

<Preparation of Oil Phase>

A vessel was charged with 500 parts of the [WAX dispersion liquid 1], 200 parts of the [prepolymer A-1], 500 parts of the [crystalline polyester resin dispersion liquid 1], 750 parts of the [polyester resin B-1], 100 parts of the [master batch 1], and 2 parts of the [ketimine compound 1] as a curing agent, followed by mixing using a TK Homomixer (product of Tokushu Kika Kogyo Co., Ltd.) at 5,000 rpm for 60 minutes, to thereby obtain [oil phase 1].

<Synthesis of Organic Fine Particle Emulsion (Particle Dispersion Liquid)>

A reaction vessel equipped with a stirring bar and a thermometer was charged with 683 parts of water, 11 parts of a sodium salt of sulfuric acid ester of methacrylic acid-ethylene oxide adduct (ELEMINOL RS-30, product of Sanyo Chemical Industries, Ltd.), 138 parts of styrene, 138 parts of methacrylic acid, and 1 part of ammonium persulfate, and the resultant mixture was stirred for 15 minutes at 400 rpm, to thereby obtain a white emulsion. The obtained emulsion was heated to have the system temperature of 75° C., and then was allowed to react for 5 hours. To the resultant mixture, 30 parts of a 1% ammonium persulfate aqueous solution was added, followed by aging for 5 hours at 75° C., to thereby obtain an aqueous dispersion liquid of a vinyl resin (a copolymer of styrene/methacrylic acid/sodium salt of sulfuric acid ester of methacrylic acid ethylene oxide adduct), i.e., [particle dispersion liquid 1].

The [particle dispersion liquid 1] was measured by LA-920 (product of HORIBA, Ltd.), and as a result, a volume average particle diameter thereof was found to be 0.14 mm. A part of the [particle dispersion liquid 1] was dried, to thereby isolate a resin content.

<Preparation of Aqueous Phase>

Water (990 parts), 83 parts of the [particle dispersion liquid], 37 parts of a 48.5% aqueous solution of sodium dodecyldiphenyl ether disulfonate (ELEMINOL MON-7, product of Sanyo Chemical Industries Ltd.), and 90 parts of ethyl acetate were mixed and stirred, to thereby obtain an opaque white liquid. The obtained liquid was used as [aqueous phase 1].

<Emulsification•Removal of Solvent>

The [aqueous phase 1] (1,200 parts) was added to a container charged with the [oil phase 1], and the resultant mixture was mixed by a TK Homomixer at 13,000 rpm for 20 minutes, to thereby obtain [emulsified slurry 1].

A container equipped with a stirrer and a thermometer was charged with the [emulsified slurry 1], followed by removing the solvent therein at 30° C. for 8 hours. Thereafter, the resultant mixture was aged at 45° C. for 4 hours, to thereby obtain [dispersion slurry 1].

<Washing•Drying>

After subjecting 100 parts of the [dispersion slurry 1] to filtration under a reduced pressure, the obtained cake was subjected twice to a series of treatments (1) to (4) described below, to thereby produce [filtration cake].

(1): ion-exchanged water (100 parts) was added to the filtration cake, followed by mixing with a TK Homomixer (at 12,000 rpm for 10 minutes), and then the mixture was filtrated;

(2): one hundred parts of 10% aqueous sodium hydroxide solution was added to the filtration cake obtained in (1), followed by mixing with a TK Homomixer (at 12,000 rpm for 30 minutes), and then the resultant mixture was filtrated under a reduced pressure;

(3): one hundred parts of 10% by mass hydrochloric acid was added to the filtration cake obtained in (2), followed by mixing with a TK Homomixer (at 12,000 rpm for 10 minutes) and then the mixture was filtrated; and (4): ion-exchanged water (300 parts) was added to the filtration cake obtained in (3), followed by mixing with a TK Homomixer (at 12,000 rpm for 10 minutes) and then the mixture was filtrated.

Next, the [filtration cake] was dried with an air-circulating drier at 45° C. for 48 hours, and then was caused to pass through a sieve with a mesh size of 75 mm, to thereby obtain [toner base particle 1].

A compositional ratio, Tg1st, Tg2nd, and a ratio of a triisocyanate component to resin components in the THF insoluble matter of the obtained [toner base particle 1] are given in Table 1-1.

<External Additive Treatment>

One hundred parts of the [toner base particle 1] was mixed with 0.6 parts by mass of the hydrophobic silica having an average particle diameter of 100 nm, 1.0 part by mass of titanium oxide having an average particle diameter of 20 nm, and 0.8 parts by mass of the hydrophobic silica fine powder having an average particle diameter of 15 nm using a Henschel mixer, to thereby obtain toner 1.

<Preparation of Carrier>

Silicone resin: organostraight silicone (100 parts by mass), 5 parts by mass of g-(2-aminoethyl)aminopropyltrimethoxy silane, and 10 parts by mass of carbon black were added to 100 parts by mass of toluene, the resultant mixture was dispersed by a homomixer for 20 minutes, to thereby prepare a resin layer coating liquid. The resin layer coating liquid was coated on 1,000 parts by mass of the surfaces of spherical magnetite particles having an average particle diameter of 50 mm, by a fluidized bed coating device, to thereby prepare a carrier.

<Preparation of Developer>

A developer was prepared by mixing 5 parts by mass of the toner 1 with 95 parts by mass of the carrier using a ball mill. Next, each of the prepared developers was evaluated for the following properties. Results are given in Table 1-1.

<Low Temperature Fixing Ability and Hot Offset Resistance>

An apparatus provided by modifying a fixing portion of IMAGEO MP C5002 (product of Ricoh Company, Ltd.) was used to perform a copy test on sheets of TYPE 6,200 (product of Ricoh Company, Ltd.).

Specifically, the cold offset temperature (minimum fixing temperature) and the high temperature offset temperature (maximum fixing temperature) were determined by changing the fixing temperature.

As the evaluation condition of the minimum fixing temperature, the paper-feeding linear velocity was set to 200 mm/sec, the surface pressure was set to 1.0 kgf/cm$^2$, and the nip width was set to 7 mm.

As the evaluation condition of the maximum fixing temperature, the paper-feeding linear velocity was set to 100 mm/sec, the surface pressure was set to 1.0 kgf/cm$^2$, and the nip width was set to 7 mm.

When the minimum fixing temperature is 110° C. or less, the resultant toner obtained in the present invention exhibits a sufficient effect of low temperature fixing ability.

When the maximum fixing temperature is 170° C. or more, the resultant toner obtained in the present invention exhibits a sufficient effect of hot offset resistance.

<Image Glossiness>

An apparatus provided by modifying a fixing portion of IMAGEO MP C5002 (product of Ricoh Company, Ltd.) was used to perform a copy test on sheets of POD GLOSS COAT 128 g/m$^2$ (product of OJI PAPER CO., LTD.).

Specifically, glossiness of the image obtained after feeding a paper at the fixing temperature of 140° C. was determined. The image after the copy test was measured for 60° glossiness using a gloss meter VG-7000 (product of NIPPON DENSHOKU INDUSTRIES CO. LTD.).

As the evaluation condition of the minimum fixing temperature, the paper-feeding linear velocity was set to 100 mm/sec, the surface pressure was set to 1.0 kgf/cm$^2$, and the nip width was set to 7 mm.

When the image glossiness is 20 or more, the resultant toner obtained in the present invention exhibits a sufficient effect of high glossiness and high image quality.

<Heat Resistant Storage Stability>

The resultant toner was stored at 50° C. for 8 hours, and was caused to pass through a sieve of 42-mesh for 2 minutes, to thereby determine a residual rate on a wire mesh. Here, the more excellent the heat resistant storage stability of the toner is, the smaller the residual rate is.

Note that, the evaluation criteria for heat resistant storage stability are as follows.

A: The residual rate is less than 5%.

B: The residual rate is 5% or more but less than 15%.

C: The residual rate is 15% or more but less than 30%.

D: The residual rate is 30% or more.

<Filming Resistance>

Using an image forming apparatus, RICOH PRO 6001 (product of Ricoh Company, Ltd.), a photoconductor was visually inspected after forming 30,000 images, and whether the toner components, mainly the release agent, were adhered to the photoconductor was evaluated based on the following criteria.

A: It is not confirmed that the toner components are adhered to the photoconductor.

B: It is confirmed that the toner components are adhered to the photoconductor, which is not problematic level for practical use.

C: It is confirmed that the toner components are adhered to the photoconductor, which is problematic level for practical use.

D: It is confirmed that the toner components are adhered to the photoconductor, which is significantly problematic level for practical use.

Example 2

First, [toner base particle 2] was obtained in the same manner as in Example 1 except that the prepolymer A-1 was changed to the prepolymer A-2. Then, [toner 2] obtained by using the [toner base particle 2] was evaluated in the same manner as in Example 1. Results are given in Table 1-1.

Example 3

First, [toner base particle 3] was obtained in the same manner as in Example 1 except that the prepolymer A-1 was changed to the prepolymer A-3. Then, [toner 3] obtained by using the [toner base particle 3] was evaluated in the same manner as in Example 1. Results are given in Table 1-1.

Example 4

First, [toner base particle 4] was obtained in the same manner as in Example 1 except that the prepolymer A-1 was changed to the prepolymer A-4. Then, [toner 4] obtained by using the [toner base particle 4] was evaluated in the same manner as in Example 1. Results are given in Table 1-1.

Example 5

First, [toner base particle 5] was obtained in the same manner as in Example 1 except that the prepolymer A-1 was changed to the prepolymer A-5. Then, [toner 5] obtained by using the [toner base particle 5] was evaluated in the same manner as in Example 1. Results are given in Table 1-1.

Example 6

First, [toner base particle 6] was obtained in the same manner as in Example 1 except that the prepolymer A-1 was changed to the prepolymer A-6. Then, [toner 6] obtained by using the [toner base particle 6] was evaluated in the same manner as in Example 1. Results are given in Table 1-2.

Example 7

First, [toner base particle 10] was obtained in the same manner as in Example 1 except that the prepolymer A-1 was changed to the prepolymer A-10. Then, [toner 10] obtained by using the [toner base particle 10] was evaluated in the same manner as in Example 1. Results are given in Table 1-2.

Example 8

First, [toner base particle 11] was obtained in the same manner as in Example 1 except that the prepolymer A-1 was changed to the prepolymer A-11. Then, [toner 11] obtained by using the [toner base particle 11] was evaluated in the same manner as in Example 1. Results are given in Table 1-2.

Example 9

First, [toner base particle 12] was obtained in the same manner as in Example 1 except that the prepolymer A-1 was changed to the prepolymer A-12. Then, [toner 12] obtained by using the [toner base particle 12] was evaluated in the same manner as in Example 1. Results are given in Table 1-2.

Example 10

First, [toner base particle 13] was obtained in the same manner as in Example 1 except that the prepolymer A-1 was changed to the prepolymer A-13. Then, [toner 13] obtained by using the [toner base particle 13] was evaluated in the same manner as in Example 1. Results are given in Table 1-2.

Example 11

First, [toner base particle 14] was obtained in the same manner as in Example 1 except that the prepolymer A-1 was changed to the prepolymer A-14. Then, [toner 14] obtained by using the [toner base particle 14] was evaluated in the same manner as in Example 1. Results are given in Table 1-3.

Example 12

First, [toner base particle 15] was obtained in the same manner as in Example 1 except that the prepolymer A-1 was changed to the prepolymer A-15. Then, [toner 15] obtained by using the [toner base particle 15] was evaluated in the same manner as in Example 1. Results are given in Table 1-3.

Example 13

First, [toner base particle 16] was obtained in the same manner as in Example 1 except that the prepolymer A-1 was changed to the prepolymer A-16. Then, [toner 16] obtained by using the [toner base particle 16] was evaluated in the same manner as in Example 1. Results are given in Table 1-3.

Example 14

First, [toner base particle 17] was obtained in the same manner as in Example 1 except that the prepolymer A-1 was changed to the prepolymer A-17. Then, [toner 17] obtained by using the [toner base particle 17] was evaluated in the same manner as in Example 1. Results are given in Table 1-3.

Example 15

First, [toner base particle 18] was obtained in the same manner as in Example 1 except that the prepolymer A-1 was changed to the prepolymer A-18. Then, [toner 18] obtained by using the [toner base particle 18] was evaluated in the same manner as in Example 1. Results are given in Table 1-3.

Comparative Example 1

First, [toner base particle 7] was obtained in the same manner as in Example 1 except that the prepolymer A-1 was changed to the prepolymer A-7. Then, [toner 7] obtained by using the [toner base particle 7] was evaluated in the same manner as in Example 1. Results are given in Table 2.

Comparative Example 2

First, [toner base particle 8] was obtained in the same manner as in Example 1 except that the prepolymer A-1 was changed to the prepolymer A-8. Then, [toner 8] obtained by using the [toner base particle 8] was evaluated in the same manner as in Example 1. Results are given in Table 2.

Comparative Example 3

First, [toner base particle 9] was obtained in the same manner as in Example 1 except that the prepolymer A-1 was changed to the prepolymer A-9. Then, [toner 9] obtained by using the [toner base particle 9] was evaluated in the same manner as in Example 1. Results are given in Table 2.

TABLE 1-1

| | | Ex. 1 | Ex. 2 | Ex. 3 | Ex. 4 | Ex. 5 |
|---|---|---|---|---|---|---|
| Polyester resin A | Compound | A-1 | A-2 | A-3 | A-4 | A-5 |
| | Mw | 45,000 | 38,000 | 48,000 | 42,000 | 40,000 |
| | Tg | −25° C. | −23° C. | −25° C. | −21° C. | −62° C. |
| Polyester resin B | Compound | B-1 | B-1 | B-1 | B-1 | B-1 |
| | Mw | 10,000 | 10,000 | 10,000 | 10,000 | 10,000 |
| | Tg | 55° C. | 55° C. | 55° C. | 55° C. | 55° C. |
| Crystalline polyester resin C | Compound | C-1 | C-1 | C-1 | C-1 | C-1 |
| | Mw | 15,000 | 15,000 | 15,000 | 15,000 | 15,000 |
| | mp | 70° C. | 70° C. | 70° C. | 70° C. | 70° C. |
| Constituent ratio (% by mass) | Resin A | 10 | 10 | 10 | 10 | 10 |
| | Resin B | 75 | 75 | 75 | 75 | 75 |
| | Resin C | 5 | 5 | 5 | 5 | 5 |
| | Release agent | 5 | 5 | 5 | 5 | 5 |
| | Colorant | 5 | 5 | 5 | 5 | 5 |
| Measurements and evaluation results | Tg1st (° C.) | 40 | 41 | 40 | 42 | 32 |
| | Tg2nd (° C.) | 20 | 21 | 22 | 25 | 15 |
| | Triisocyanate component in THF insoluble matter (mol %) | 0.3 | — | 0.2 | 0.4 | 0.3 |

TABLE 1-1-continued

| | | Ex. 1 | Ex. 2 | Ex. 3 | Ex. 4 | Ex. 5 |
|---|---|---|---|---|---|---|
| | Minimum fixing temperature | 100° C. | 100° C. | 105° C. | 105° C. | 100° C. |
| | Maximum fixing temperature | 190° C. | 180° C. | 190° C. | 180° C. | 180° C. |
| | Image glossiness | 30 | 28 | 25 | 25 | 28 |
| | Heat resistant storage stability | A | A | A | B | B |
| | Filming resistance | A | A | A | B | B |

TABLE 1-2

| | | Ex. 6 | Ex. 7 | Ex. 8 | Ex. 9 | Ex. 10 |
|---|---|---|---|---|---|---|
| Polyester resin A | Compound | A-6 | A-10 | A-11 | A-12 | A-13 |
| | Mw | 43,000 | 58,000 | 39,000 | 45,000 | 35,000 |
| | Tg | 5° C. | −40° C. | −58° C. | −2° C. | −25° C. |
| Polyester resin B | Compound | B-1 | B-1 | B-1 | B-1 | B-1 |
| | Mw | 10,000 | 10,000 | 10,000 | 10,000 | 10,000 |
| | Tg | 55° C. | 55° C. | 55° C. | 55° C. | 55° C. |
| Crystalline polyester resin C | Compound | C-1 | C-1 | C-1 | C-1 | C-1 |
| | Mw | 15,000 | 15,000 | 15,000 | 15,000 | 15,000 |
| | mp | 70° C. | 70° C | 70° C. | 70° C. | 70° C. |
| Constituent ratio (% by mass) | Resin A | 10 | 10 | 10 | 10 | 10 |
| | Resin B | 75 | 75 | 75 | 75 | 75 |
| | Resin C | 5 | 5 | 5 | 5 | 5 |
| | Release agent | 5 | 5 | 5 | 5 | 5 |
| | Colorant | 5 | 5 | 5 | 5 | 5 |
| Measurements and evaluation results | Tg1st (° C.) | 48 | 35 | 33 | 46 | 41 |
| | Tg2nd (° C.) | 25 | 15 | 16 | 25 | 25 |
| | Triisocyanate component in THF insoluble matter (mol %) | 0.4 | 0.1 | 0.3 | 0.4 | — |
| | Minimum fixing temperature | 110° C. | 90° C. | 100° C. | 100° C. | 105° C. |
| | Maximum fixing temperature | 190° C. | 200° C. | 190° C. | 190° C. | 180° C. |
| | Image glossiness | 25 | 35 | 32 | 28 | 25 |
| | Heat resistant storage stability | A | A | A | A | B |
| | Filming resistance | A | B | A | A | B |

TABLE 1-3

| | | Ex. 11 | Ex. 12 | Ex. 13 | Ex. 14 | Ex. 15 |
|---|---|---|---|---|---|---|
| Polyester resin A | Compound | A-14 | A-15 | A-16 | A-17 | A-18 |
| | Mw | 40,000 | 39,000 | 35,000 | 60,000 | 62,000 |
| | Tg | −25° C. | −25° C. | −20° C | −38° C. | −33° C. |
| Polyester resin B | Compound | B-1 | B-1 | B-1 | B-1 | B-1 |
| | Mw | 10,000 | 10,000 | 10,000 | 10,000 | 10,000 |
| | Tg | 55° C. | 55° C. | 55° C. | 55° C. | 55° C. |
| Crystalline polyester resin C | Compound | C-1 | C-1 | C-1 | C-1 | C-1 |
| | Mw | 15,000 | 15,000 | 15,000 | 15,000 | 15,000 |
| | mp | 70° C. | 70° C. | 70° C. | 70° C. | 70° C. |
| Constituent ratio (% by mass) | Resin A | 10 | 10 | 10 | 10 | 10 |
| | Resin B | 75 | 75 | 75 | 75 | 75 |
| | Resin C | 5 | 5 | 5 | 5 | 5 |

TABLE 1-3-continued

| | | Ex. 11 | Ex. 12 | Ex. 13 | Ex. 14 | Ex. 15 |
|---|---|---|---|---|---|---|
| | Release agent | 5 | 5 | 5 | 5 | 5 |
| | Colorant | 5 | 5 | 5 | 5 | 5 |
| Measurements and evaluation results | Tg1st (° C.) | 42 | 42 | 43 | 35 | 35 |
| | Tg2nd (° C.) | 25 | 25 | 25 | 15 | 15 |
| | Triisocyanate component in THF insoluble matter (mol %) | 0.4 | 0.4 | 0.4 | 0.6 | 1.1 |
| | Minimum fixing temperature | 105° C. | 105° C. | 105° C. | 90° C. | 105° C. |
| | Maximum fixing temperature | 180° C. | 180° C. | 180° C. | 200° C. | 200° C. |
| | Image glossiness | 25 | 25 | 32 | 32 | 25 |
| | Heat resistant storage stability | B | B | B | A | A |
| | Filming resistance | B | B | B | A | A |

TABLE 2

| | | Comp. Ex. 1 | Comp. Ex. 2 | Comp. Ex. 3 |
|---|---|---|---|---|
| Polyester resin A | Compound | A-7 | A-8 | A-9 |
| | Mw | 55,000 | 32,000 | 150,000 |
| | Tg | −20° C. | −25° C. | −40° C. |
| Polyester resin B | Compound | B-1 | B-1 | B-1 |
| | Mw | 10,000 | 10,000 | 10,000 |
| | Tg | 55° C. | 55° C. | 55° C. |
| Crystalline polyester resin C | Compound | C-1 | C-1 | C-1 |
| | Mw | 15,000 | 15,000 | 15,000 |
| | mp | 70° C. | 70° C. | 70° C. |
| Constituent ratio (% by mass) | Resin A | 10 | 10 | 10 |
| | Resin B | 75 | 75 | 75 |
| | Resin C | 5 | 5 | 5 |
| | Release agent | 5 | 5 | 5 |
| | Colorant | 5 | 5 | 5 |
| Measurements and evaluation results | Tg1st (° C.) | 40 | 38 | 35 |
| | Tg2nd (° C.) | 24 | 22 | 20 |
| | Triisocyanate component in THF insoluble matter (mol %) | — | — | — |
| | Minimum fixing temperature | 120° C. | 115° C. | 115° C. |
| | Maximum fixing temperature | 190° C. | 150° C. | 190° C. |
| | Image glossiness | 15 | 25 | 10 |
| | Heat resistant storage stability | C | D | C |
| | Filming resistance | C | D | C |

Aspects of the present invention are as follows, for example:

<1> A toner, including:

a polyester resin, wherein the polyester resin has a structure represented by any one of formulas 1) to 3) below:

1) R1-(NHCONH-R2)n-,

2) R1-(NHCOO-R2)n-, and

3) R1-(OCONH-R2)n-, where n is 3 or more,

R1 represents an aromatic organic group or an aliphatic organic group, and

R2 represents a group derived from a resin that is polyester formed of polycarboxylic acid, polyol, or both thereof; or that is a modified polyester obtained by modifying polyester with isocyanate.

<2> The toner according to <1>, wherein the organic group represented by the R1 contains an isocyanurate skeleton represented by formula (I) below:

[Chem. 2]

(I)

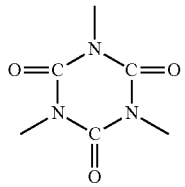

<3> The toner according to <1> or <2>, wherein the R2 is the group derived from the resin that is the modified polyester obtained by modifying polyester with isocyanate.

<4> The toner according to any one of <1> to <3>, wherein the polyester resin contains a diol component as a constituent component, where the diol component contains an aliphatic diol having 4 to 12 carbon atoms in an amount of 50 mol % or more, a portion of the diol component to be a main chain has an odd number of carbon atoms, and the diol component contains an alkyl group in a side chain of the diol component.

<5> The toner according to any one of <1> to <4>, wherein a glass transition temperature of the polyester resin is −60° C. to 0° C.

<6> The toner according to any one of <1> to <5>, wherein the n is 3.

<7> The toner according to any one of <1> to <6>, wherein the polyester resin contains a dicarboxylic acid component as a constituent component, where the dicarboxylic acid component contains an aliphatic dicarboxylic acid having 4 to 12 carbon atoms in an amount of 30 mol % or more.

<8> The toner according to any one of <1> to <7>, wherein the toner contains a trivalent isocyanate component in an amount of 0.2 mol % to 1.0 mol %, relative to resin components in the THF insoluble matter of the toner.

<9> The toner according to any one of <1> to <8>, further including a second polyester resin, wherein a glass transition temperature of the second polyester resin is 40° C. to 70° C., and wherein the toner has a glass transition temperature (Tg1st) of 20° C. to 50° C., where the glass transition temperature (Tg1st) is a glass transition temperature measured in first heating of differential scanning calorimetry (DSC) of the toner.

<10> The toner according to any one of <1> to <9>, further including a crystalline polyester resin, wherein a melting point of the crystalline polyester resin is 60° C. to 80° C., and wherein a difference (Tg1st-Tg2nd) is 10° C. or more, where the difference (Tg1 st-Tg2nd) is a difference between the glass transition temperature (Tg1st) and a glass transition temperature (Tg2nd), where the glass transition temperature (Tg2nd) is a glass transition temperature measured in second heating of differential scanning calorimetry (DSC) of the toner.

<11> The toner according to <10>, wherein the crystalline polyester resin contains a straight-chain, saturated aliphatic dicarboxylic acid having 4 to 12 carbon atoms, and a straight-chain, saturated aliphatic diol having 2 to 12 carbon atoms.

<12> A toner accommodating unit, including:

the toner according to any one of <1> to <11>.

<13> An image forming apparatus, including:

an electrostatic latent image bearer;

an electrostatic latent image forming unit configured to form an electrostatic latent image on the electrostatic latent image bearer; and a developing unit containing a toner and configured to develop the electrostatic latent image formed on the electrostatic latent image bearer, to thereby form a visible image, wherein the toner is the toner according to any one of <1> to <11>.

REFERENCE SIGNS LIST

10 Electrostatic latent image bearer
21 Exposing device
25 Fixing device
61 Developing device
160 Charging device

The invention claimed is:

1. A toner, comprising:

a first non-crystalline polyester resin having a uniform network structure,
wherein:
the first non-crystalline polyester resin has a glass transition temperature of −62° C. to 5° C., a weight-average molecular weight ranging from 35,000 to 62,000, and a structure represented by any one of formulae 1) to 3):
1) R1-(NHCONH-R2)n-,
2) R1-(NHCOO-R2)n-, and
3) R1-(OCONH-R2)n-,
wherein,
n is 3 or more,
R2 represents a linear polyester where R2 is the same or different at each occurrence in the structure of each of formulae 1) to 3), and
in formula 1), R1 represents an aromatic organic group or an aliphatic organic group having 20 or less carbon atoms,
in formula 2), R1 represents an aromatic organic group or an aliphatic organic group having 20 or less carbon atoms, and
in formula 3), R1 represents an aromatic organic group or an aliphatic organic group having 20 or less carbon atoms;

a second non-crystalline polyester resin comprising a diol component and a dicarboxylic acid component as constituent components,
wherein:
the second polyester resin has a glass transition temperature of 40° C. to 70° C. and a weight-average molecular weight ranging from 3,000 to 10,000; and a crystalline polyester resin,
wherein:
the crystalline polyester resin has a melting point of 60° C. to 80° C.

wherein said toner has a glass transition temperature (Tg1st) of 20° C. to 50° C., where the glass transition temperature (Tg1st) is a glass transition temperature measured in first heating of differential scanning calorimetry (DSC) of the toner, and a difference (Tg1st−Tg2nd) of 10° C. or more, where the difference (Tg1st-Tg2nd) is a difference between a glass transition temperature (Tg1st) and a glass transition temperature (Tg2nd), where the glass transition temperature (Tg2nd) is a glass transition temperature measured in second heating of differential scanning calorimetry (DSC) of the toner.

2. The toner according to claim 1, wherein R1 comprises a structure of formula (I) below:

(I)

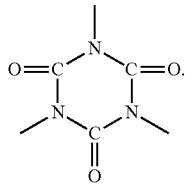

3. The toner according to claim 1, wherein the linear polyester in the first non-crystalline polyester resin contains a diol component as a constituent component, where the diol component contains an aliphatic diol having 4 to 12 carbon atoms in an amount of 50 mol% or more, a portion of the dial component to be a main chain has an odd number of carbon atoms, and the diol component contains an alkyl group in a side chain of the diol component.

4. The toner according to claim 1, wherein n is 3.

5. The toner according to claim 1, wherein the linear polyester in the first non-crystalline polyester resin contains a dicarboxylic acid component as a constituent component, where the dicarboxylic acid component contains an aliphatic dicarboxylic acid having 4 to 12 carbon atoms in an amount of 30 mol% or more.

6. The toner according to claim 1, wherein R1 is the group obtained by excluding a terminal isocyanate group from a trivalent or higher valent polyisocyanate, an amount of which is from 0.2 mol% to 1.0 mol%, relative to resin components in the tetrahydrofuran (THF) insoluble matter of the toner.

7. The toner according to claim 1, wherein the crystalline polyester resin contains a straight-chain, saturated aliphatic dicarboxylic acid having 4 to 12 carbon atoms, and a straight-chain, saturated aliphatic diol having 2 to 12 carbon atoms.

8. A toner accommodating unit, comprising:

the toner according to claim 1.

9. An image forming apparatus, comprising:

an electrostatic latent image bearer;

an electrostatic latent image forming unit configured to form an electrostatic latent image on the electrostatic latent image bearer; and a developing unit containing a toner and configured to develop the electrostatic latent image formed on the electrostatic latent image bearer, to thereby form a visible image, wherein the toner is the toner according to claim 1.

10. The toner according to claim 1, wherein the first non-crystalline polyester resin is produced by any one of the methods (a) to (c):

(a) reacting a diol component with a dicarboxylic acid component through an ester reaction to obtain a linear polyester polyol having a hydroxyl group at the end of the chain, and reacting the linear polyester polyol with a trivalent or higher valent isocyanate;

(b) reacting a diol component with a dicarboxylic acid component through an ester reaction to obtain a linear polyester polyol having a hydroxyl group at the end of the chain, reacting the linear polyester polyol with a divalent polyisocyanate to obtain an isocyanate-modified polyester, and reacting the isocyanate-modified polyester with a trivalent or higher valent isocyanate in a presence of water;

(c) reacting a diol component with a dicarboxylic acid component through an ester reaction to obtain a linear polyester polyol having a hydroxyl group at the end of the chain, reacting the linear polyester polyol with a divalent polyisocyanate to obtain an isocyanate-modified polyester, and reacting the isocyanate-modified polyester with a trihydric or higher hydric alcohol.

11. The toner according to claim 1, wherein the first non-crystalline polyester resin has a glass transition temperature of −60° C. to 0°C.

* * * * *